US009061218B2

(12) United States Patent
DiBartolo et al.

(10) Patent No.: US 9,061,218 B2
(45) Date of Patent: Jun. 23, 2015

(54) TRAIN TRACKS

(75) Inventors: Michael B. DiBartolo, Schiller Park, IL (US); Gary Aigner, E. Greenwich, RI (US); Jamie MacBain, Chicago, IL (US); Jason A. Moreno, Chicago, IL (US)

(73) Assignee: TOMY INTERNATIONAL, INC., Dyersville, IA (US)

( * ) Notice: Subject to any disclaimer, the term of this patent is extended or adjusted under 35 U.S.C. 154(b) by 449 days.

(21) Appl. No.: 13/500,263

(22) PCT Filed: Oct. 6, 2010

(86) PCT No.: PCT/US2010/051714

§ 371 (c)(1), (2), (4) Date: Nov. 6, 2012

(87) PCT Pub. No.: WO2011/044300

PCT Pub. Date: Apr. 14, 2011

(65) Prior Publication Data

US 2013/0126628 A1 May 23, 2013

Related U.S. Application Data

(60) Provisional application No. 61/249,229, filed on Oct. 6, 2009.

(51) Int. Cl.

| | |
|---|---|
| ***E01B 23/00*** | (2006.01) |
| ***A63H 19/30*** | (2006.01) |
| ***A63H 18/02*** | (2006.01) |
| ***A63H 18/08*** | (2006.01) |

(52) U.S. Cl.
CPC ..... *A63H 19/30* (2013.01); *A63H 18/02* (2013.01); *A63H 18/08* (2013.01)

(58) Field of Classification Search
USPC ..... 238/10 A, 10 E, 10 F, 10 R
See application file for complete search history.

(56) References Cited

U.S. PATENT DOCUMENTS

| | | | | |
|---|---|---|---|---|
| 1,544,555 | A * | 7/1925 | Chase | 104/54 |
| 4,095,743 | A * | 6/1978 | Birdsall | 238/10 F |
| 5,160,091 | A * | 11/1992 | Hesse | 238/10 E |

(Continued)

FOREIGN PATENT DOCUMENTS

| | | |
|---|---|---|
| CN | 2636934 | 9/2004 |
| CN | 1616135 | 5/2005 |

(Continued)

OTHER PUBLICATIONS

Japanese Office action for JP Application No. 2012-533297 dated Jan. 27, 2014.

(Continued)

*Primary Examiner* — Jason C Smith
(74) *Attorney, Agent, or Firm* — Michael Best & Friedrich LLP

(57) ABSTRACT

A toy track system configured to provide an infinite number of track layouts with varying levels. The toy track system includes track pieces, vertically-oriented support pieces configured to connect to the track pieces and provide the varying elevations of the track, and platforms configured to connect to the track pieces and provide support for destinations positioned adjacent to and/or over the track pieces.

20 Claims, 43 Drawing Sheets

(56) References Cited

U.S. PATENT DOCUMENTS

| | | | | | |
|---|---|---|---|---|---|
| 5,454,513 | A | * | 10/1995 | Wilson | 238/10 E |
| 5,564,962 | A | * | 10/1996 | Navarrete Espinosa | 446/128 |
| 5,752,678 | A | * | 5/1998 | Riley | 246/415 A |
| 5,826,835 | A | * | 10/1998 | Wilson et al. | 246/415 A |
| 5,979,783 | A | * | 11/1999 | Toht et al. | 238/10 E |
| 6,299,072 | B1 | * | 10/2001 | Burns | 238/10 F |
| 6,427,926 | B1 | * | 8/2002 | Lai | 238/10 R |
| D481,424 | S | * | 10/2003 | Rothkopf et al. | D21/565 |
| 6,648,237 | B2 | * | 11/2003 | Rothkopf et al. | 238/10 E |
| 7,354,006 | B1 | * | 4/2008 | Bricker | 238/10 R |
| 2009/0025617 | A1 | * | 1/2009 | Brown | 108/153.1 |
| 2010/0081356 | A1 | * | 4/2010 | Lutchen et al. | 446/444 |
| 2013/0126628 | A1 | * | 5/2013 | DiBartolo et al. | 238/10 A |

FOREIGN PATENT DOCUMENTS

| | | |
|---|---|---|
| EP | 0314090 | 5/1989 |
| EP | 1334756 | 8/2003 |
| JP | 52-10472 | 3/1977 |
| JP | 2-159293 | 6/1990 |
| JP | H02159293 | 6/1990 |

OTHER PUBLICATIONS

Chinese Office action for CN Application No. 201080054840.6 dated Mar. 3, 2014.

TOMY Company, Ltd. Pla Rail railroad toys; http://www.takaratomy.co.jp/english/products/plarail/what/index.html; available prior to Oct. 6, 2009.

PCT International Search Report and Written Opinion for International Application No. PCT/US2010/051714 mailed Jun. 23, 2011.

European Search Report for EP Application No. 10822651.5 dated Aug. 2, 2013.

* cited by examiner

Crossing track plastic wood

TRAIN TRACKS

RELATED APPLICATIONS

This application is a non-provisional application of and claims priority to U.S. Provisional Patent Application Ser. No. 61/249,229, filed on Oct. 6, 2009, the contents of which are incorporated herein by reference.

BACKGROUND OF THE INVENTION

Children have enjoyed playing with toys, such as dolls, action figures, etc., including vehicles such as toy train sets for many years. Toy train sets come in many different forms, such as model railroad sets, remote controlled sets, and wooden sets.

Existing toy train sets include tracks and support pieces that form configurations that remain on a single level. Some toy train sets can be built to form configurations on two levels, i.e., some tracks positioned over and above other tracks that are supported by a support surface. Any track layouts having configurations of more than two levels can be unstable, unuseable, and non-entertaining due to the track collapsing.

SUMMARY OF THE INVENTION

Toy train sets include a plurality of track pieces that connect together to form many different types of track configurations. The connection mechanisms incorporated with or on the track pieces of the present invention allow for unique configurations and many different play scenarios. The connection mechanisms also allow for a combination of different materials such as wood and plastic to be used for the track pieces.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein are for the purpose of description and should not be regarded as limiting.

Although directional references, such as upper, lower, downward, upward, rearward, bottom, front, rear, etc., may be made herein in describing the drawings, these references are made relative to the drawings (as normally viewed) for convenience. These directions are not intended to be taken literally or limit the present invention in any form. In addition, terms such as "first," "second," and "third" are used herein for purposes of description and are not intended to indicate or imply relative importance or significance.

The invention relates to a toy train system having a track system configured to support one or more destinations or playsets and upon which one or more vehicles traverse. The track system includes a plurality of different track pieces 10 as illustrated in FIGS. 1-7, 20-21, and 23-29. The different track pieces 10 can be assembled into any configuration that the imagination allows. The track pieces 10 illustrated in FIGS. 1-7, 20-21, and 23-29 are straight, curved, hilly (e.g., having a peak and a trough), T-shaped, cross-shaped, and inclined. The track pieces 10 can have other suitable shapes, which are also possible and contemplated by the invention. The track pieces 10 can be assembled into many different configurations as desirable by the user. FIGS. 12-19, 22, 30-33, and 38-39 illustrate just a few of the different configurations possible with the track pieces 10.

The track pieces 10 are configured to be removably coupled together to define a track 14. The track 14 forms a surface for a vehicle 18, such as a train (see FIG. 29) to traverse (e.g., roll, slide, glide, etc.). The track 14 can have a starting point and an ending point. The starting point and ending point may be coupled together or they may be at different locations along the track.

The track system also includes a plurality of support pieces 22 as illustrated in FIGS. 8-10, 22, and 35-37. The support pieces 22 are configured to couple to and support the track pieces 10 in its many different configurations. The support pieces 22 can be coupled together and/or to the track pieces 10 to support the track pieces 10 at different elevations.

Figure 33:
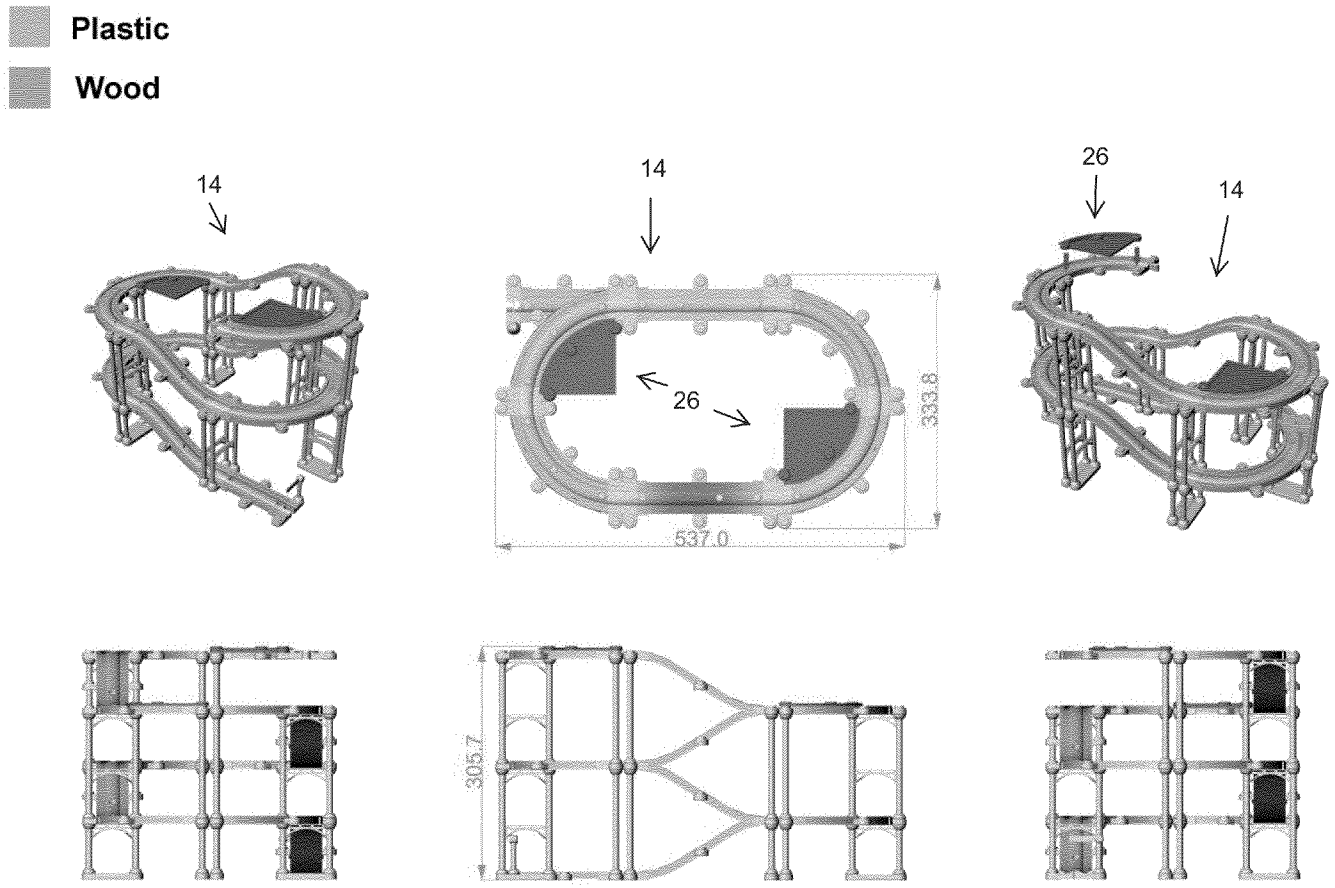
FIGS. 33-34 illustrate several views of a platform of the toy track system.
Figure 34:
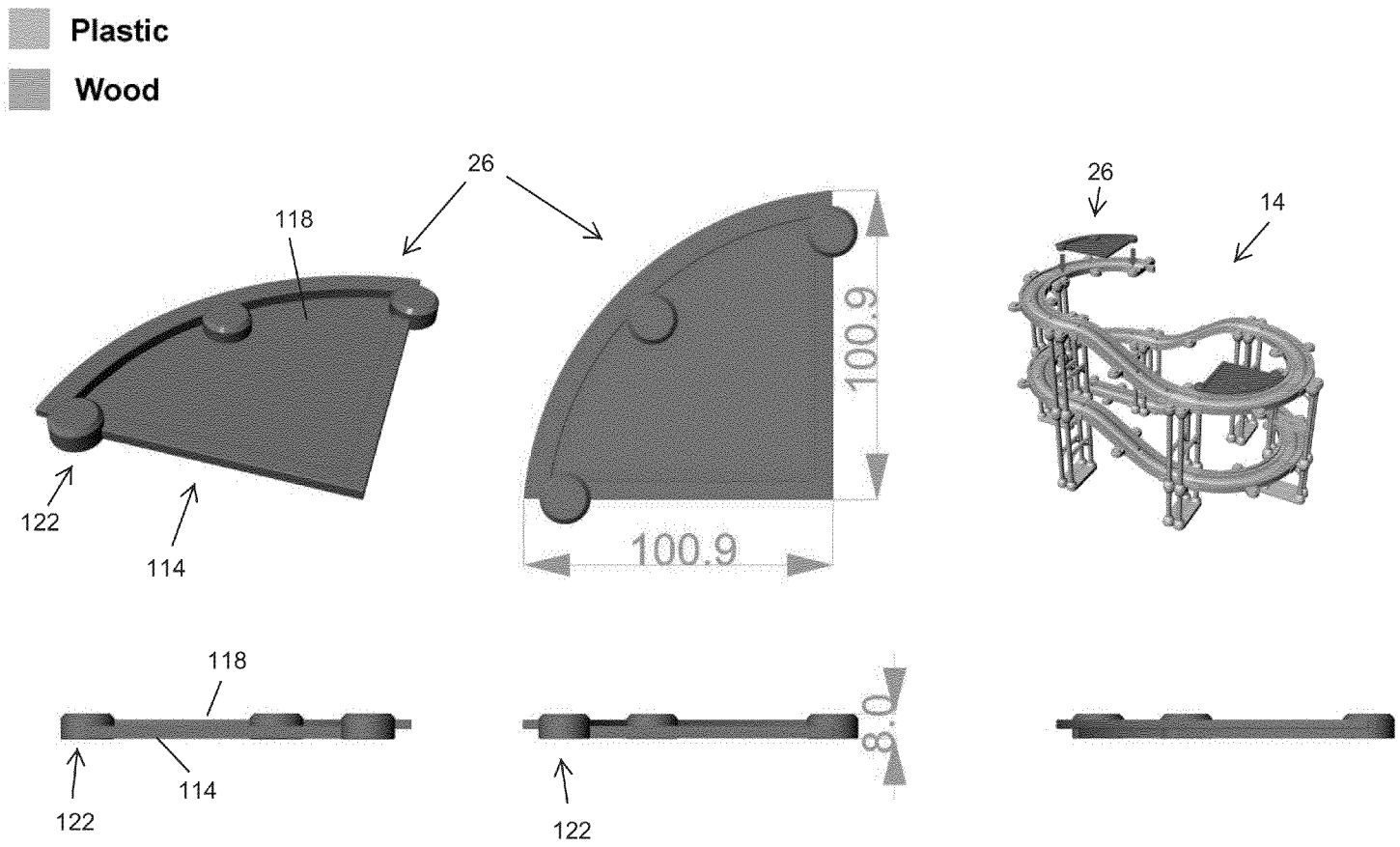
Figure 35:
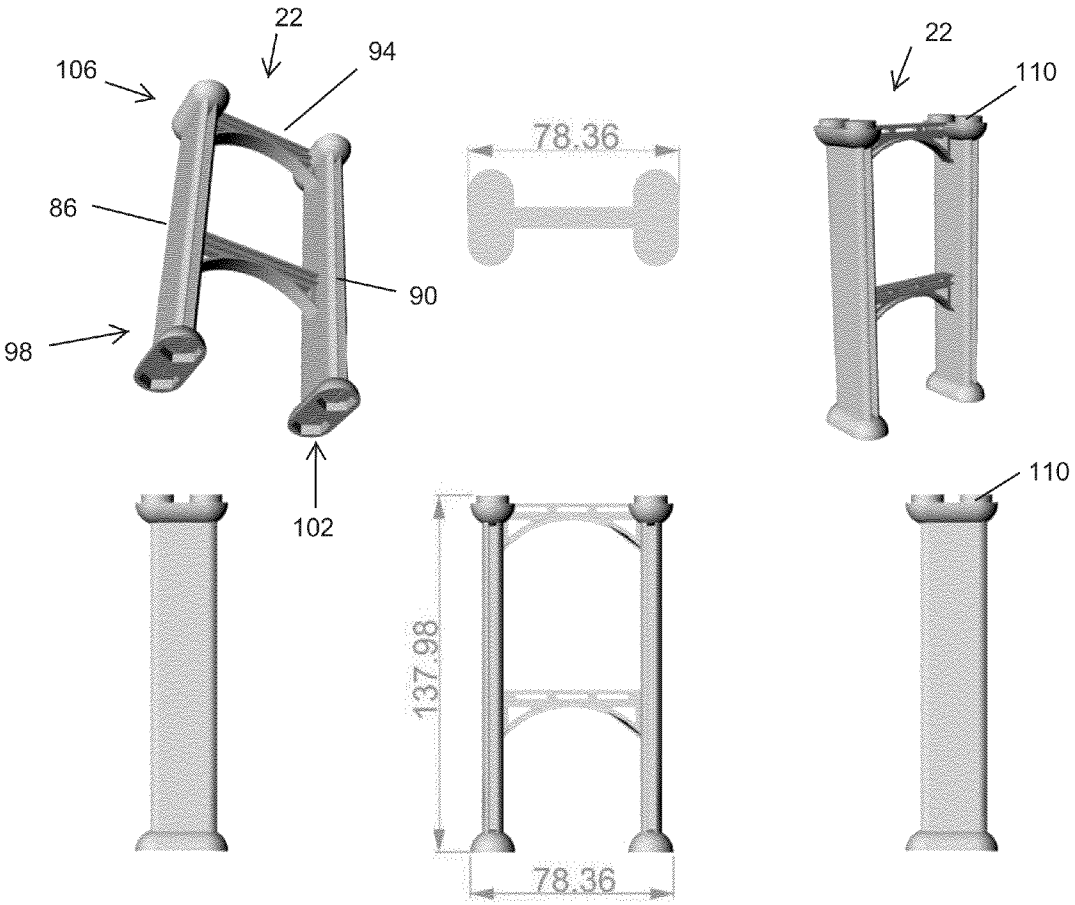
FIGS. 35-37 illustrate several views of a support piece of the toy track system.
Figure 36:
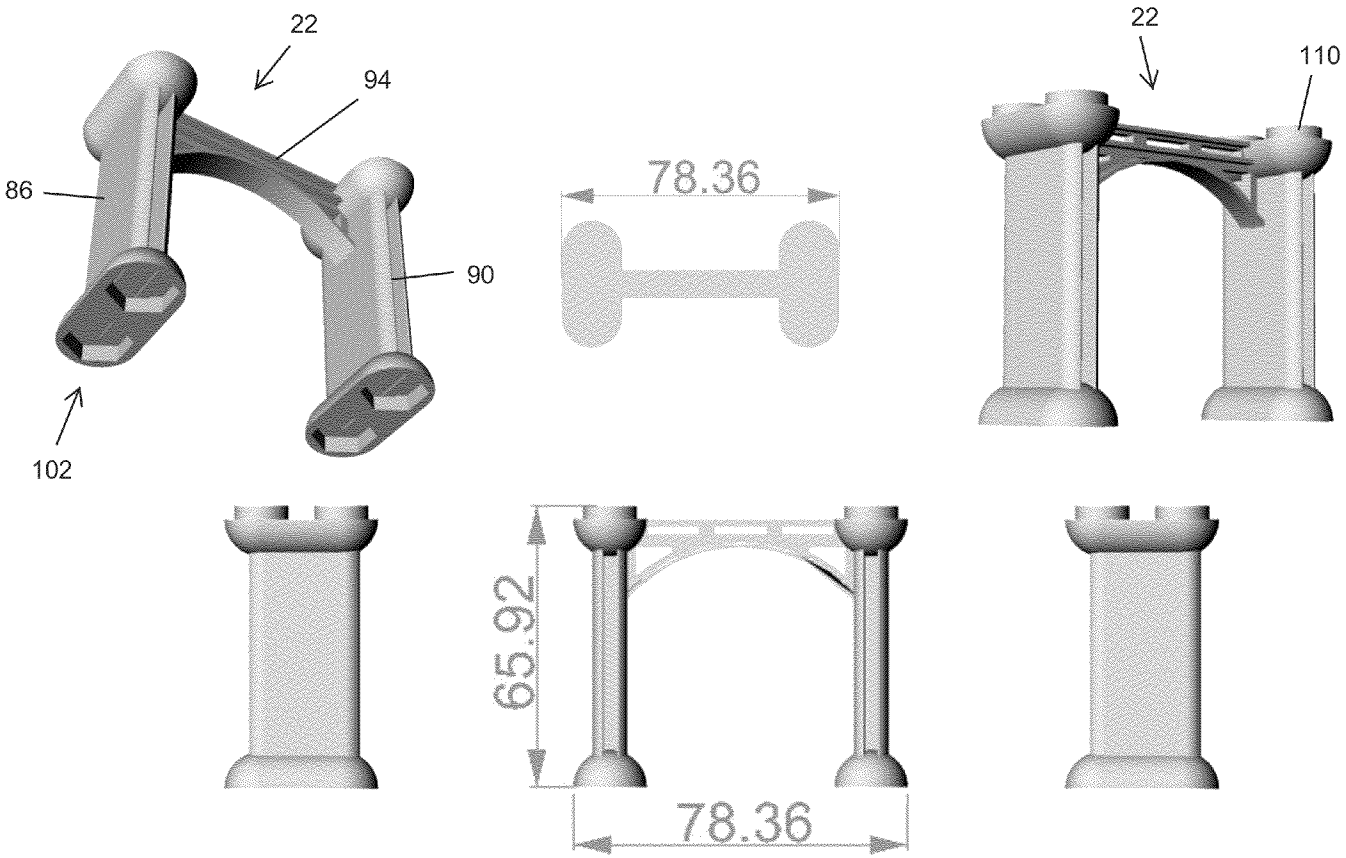
Figure 37:
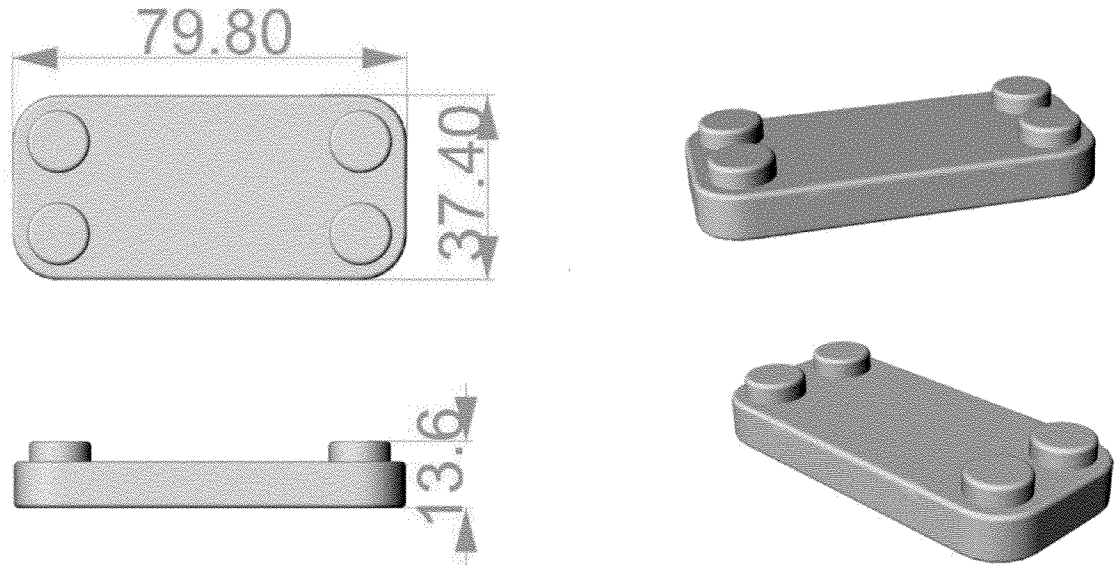
Figure 38:
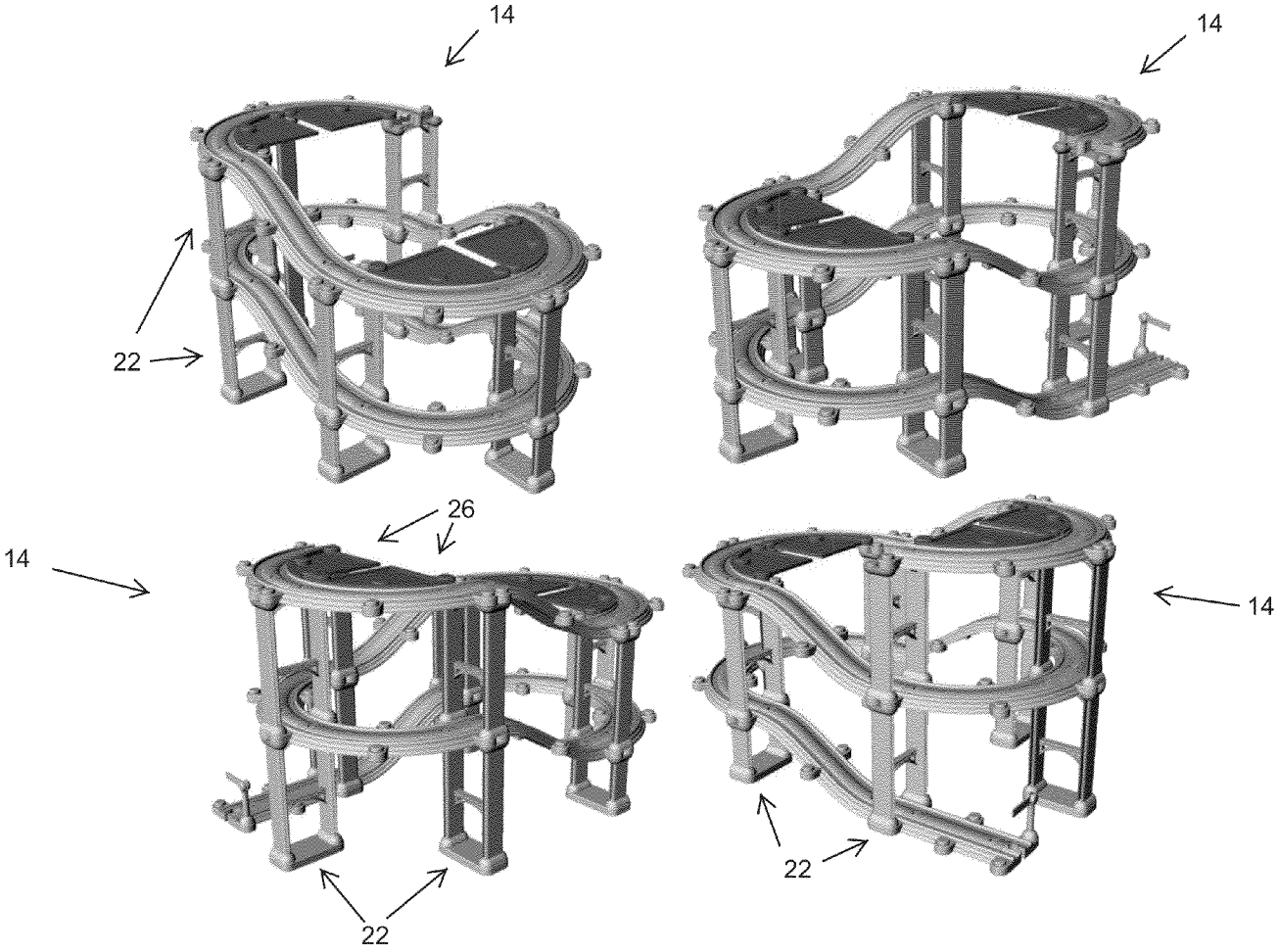
FIGS. 38-39 illustrate several views of a track layout formed with the toy track system.
Figure 39:
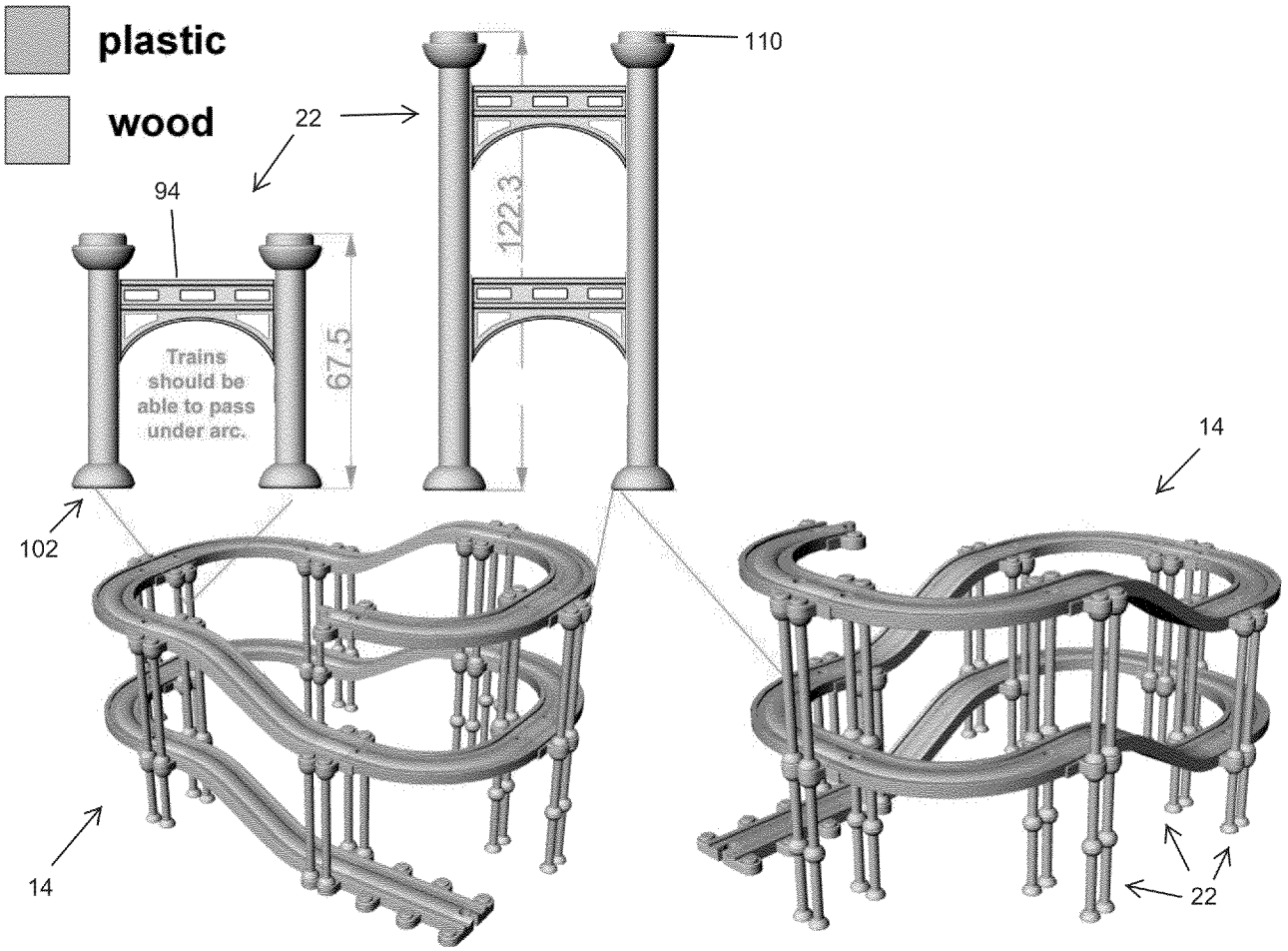

The track system also includes a plurality of platforms 26 as illustrated in FIGS. 33-34 and 38 configured to couple to and support various accessories associated with the toy train system. For example, the platforms 26 allow destinations, such as buildings and other playset features to be coupled to and/or positioned adjacent to and/or over the track 14.

Figure 11:
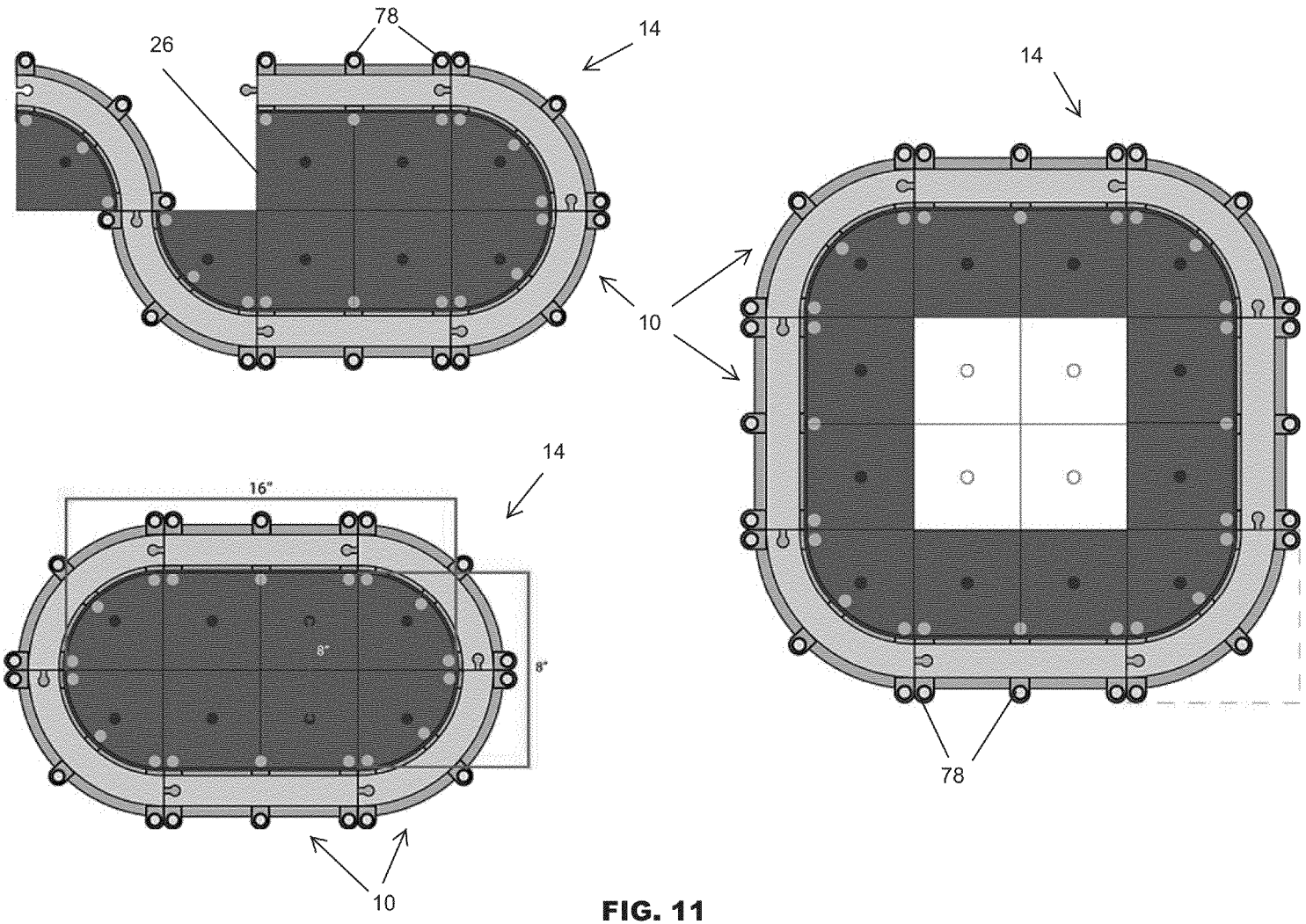
FIG. 11 illustrates the modularity of the toy track system.
Figure 12:
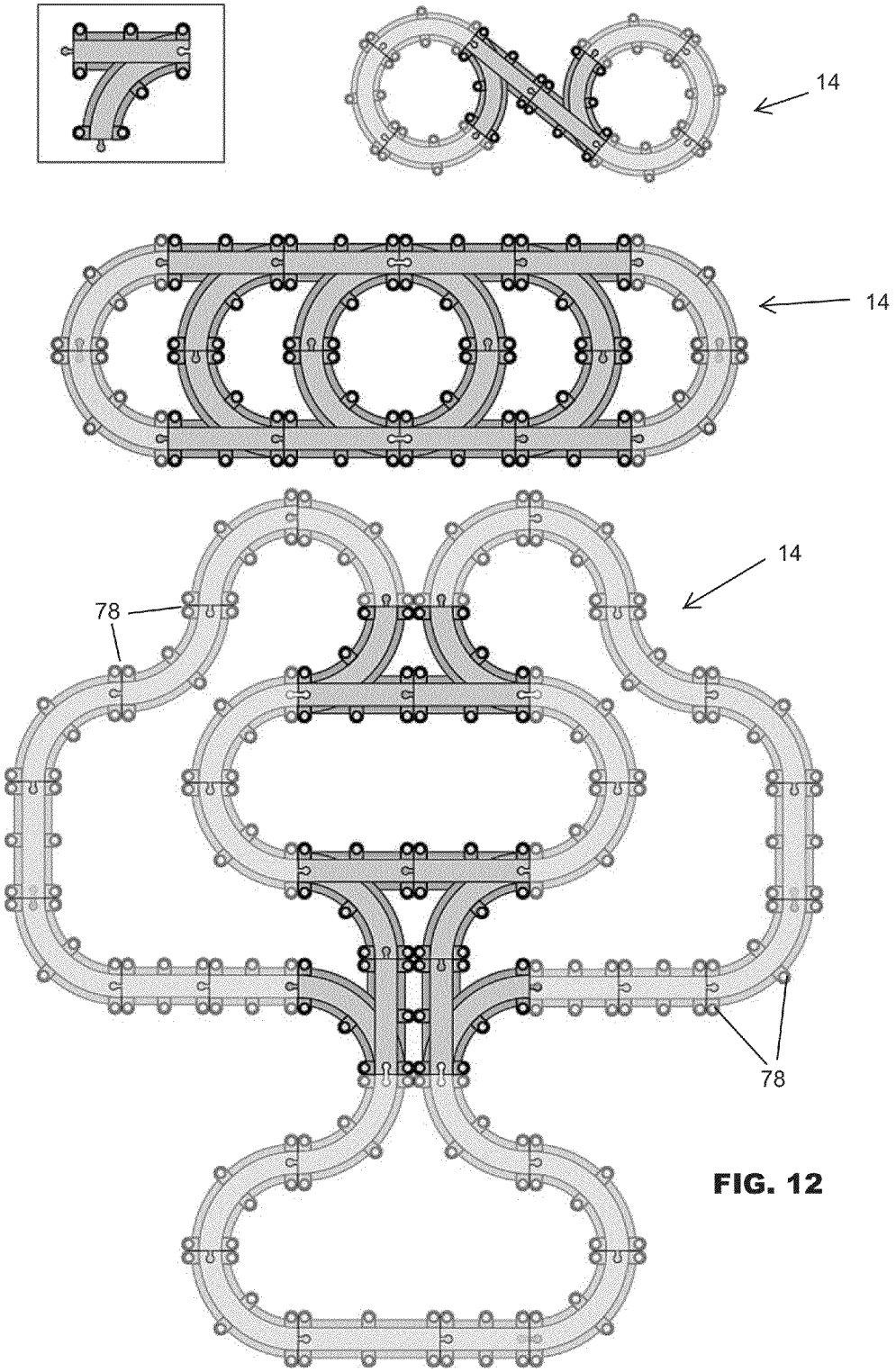
FIGS. 12-13 illustrate a top view of a plurality of track layouts formed with the toy track system.
Figure 13:
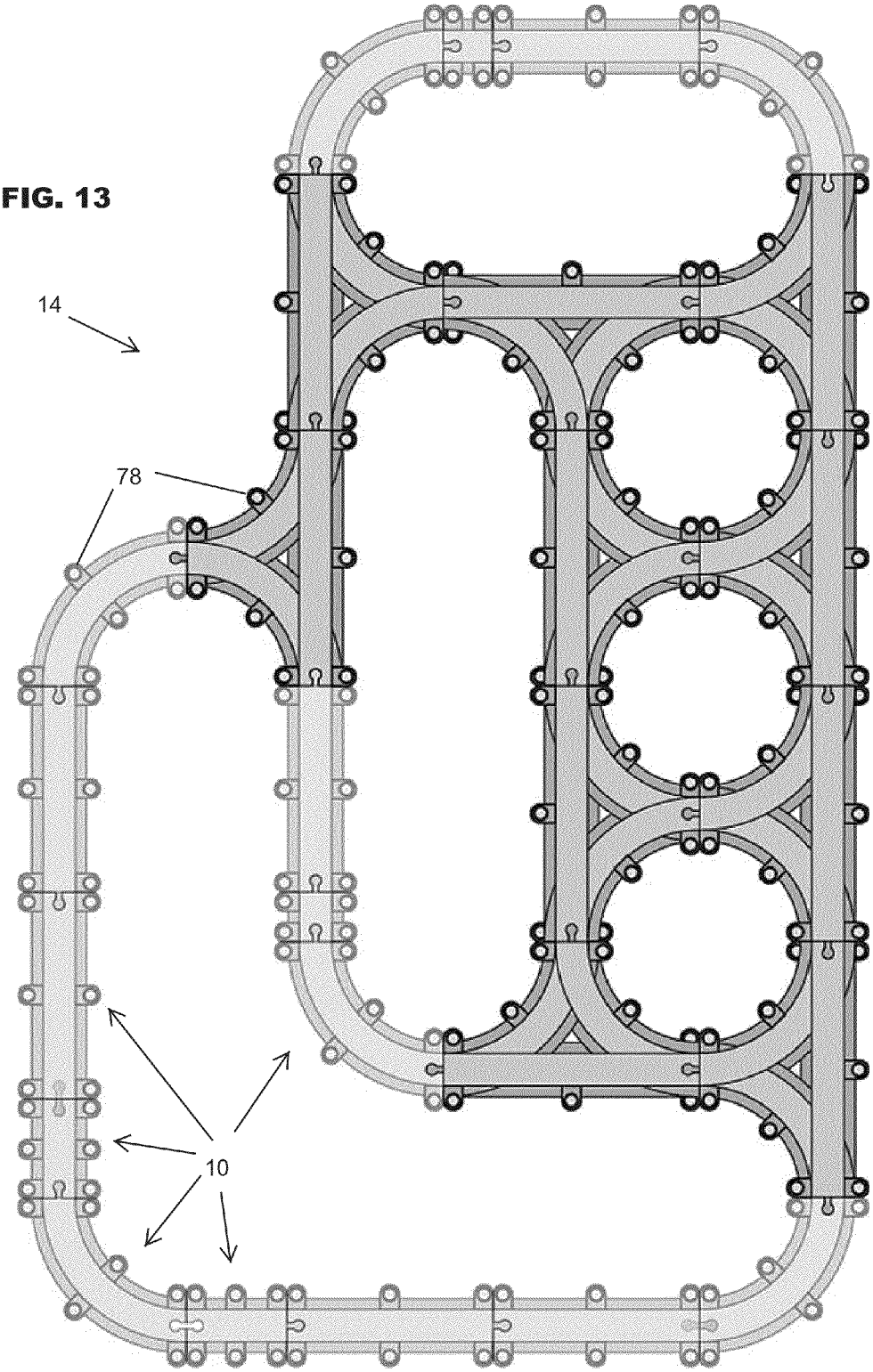
Figure 14:
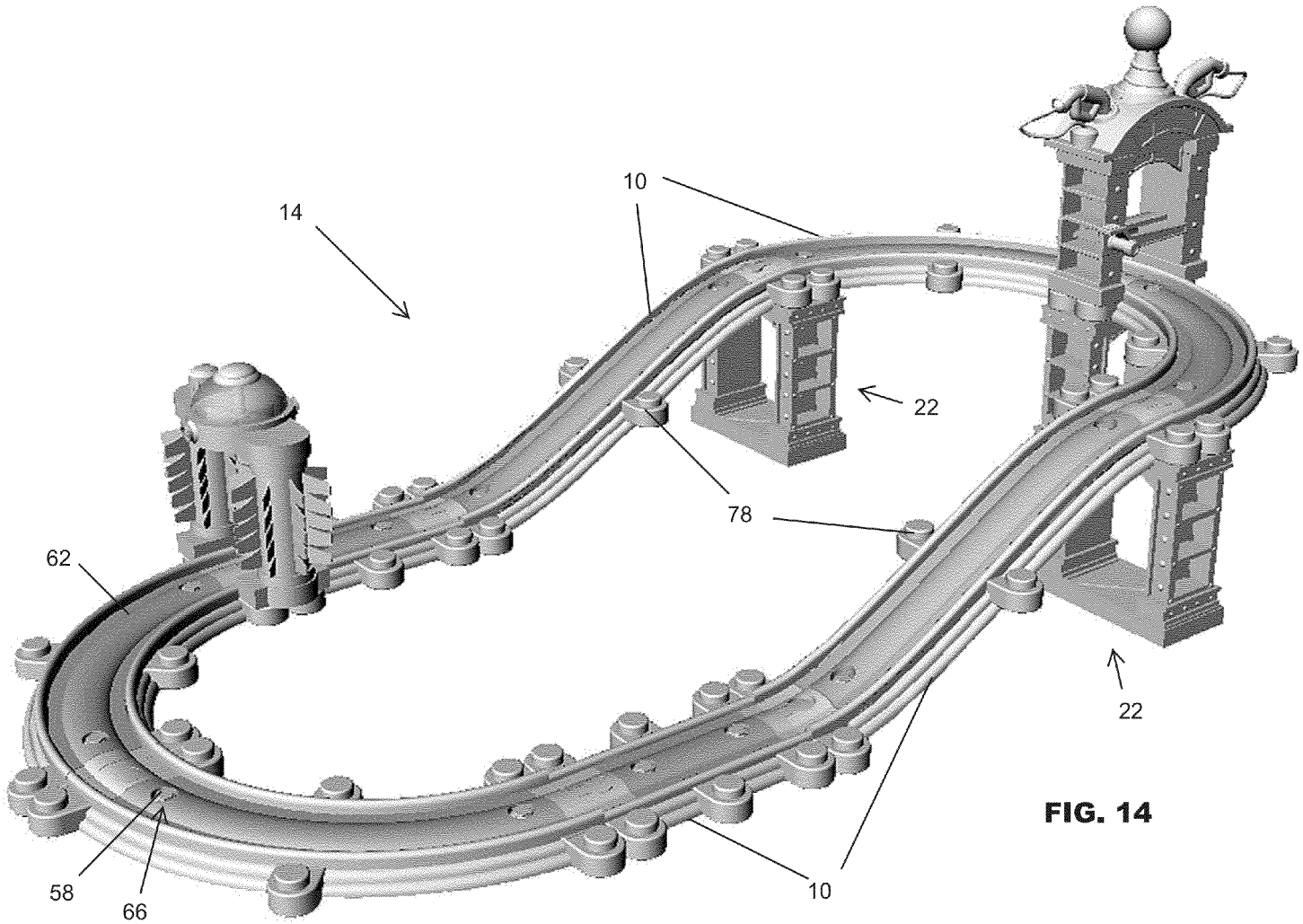
FIGS. 14-19 illustrate a plurality of views of a plurality of track layouts formed with the toy track system.
Figure 15:
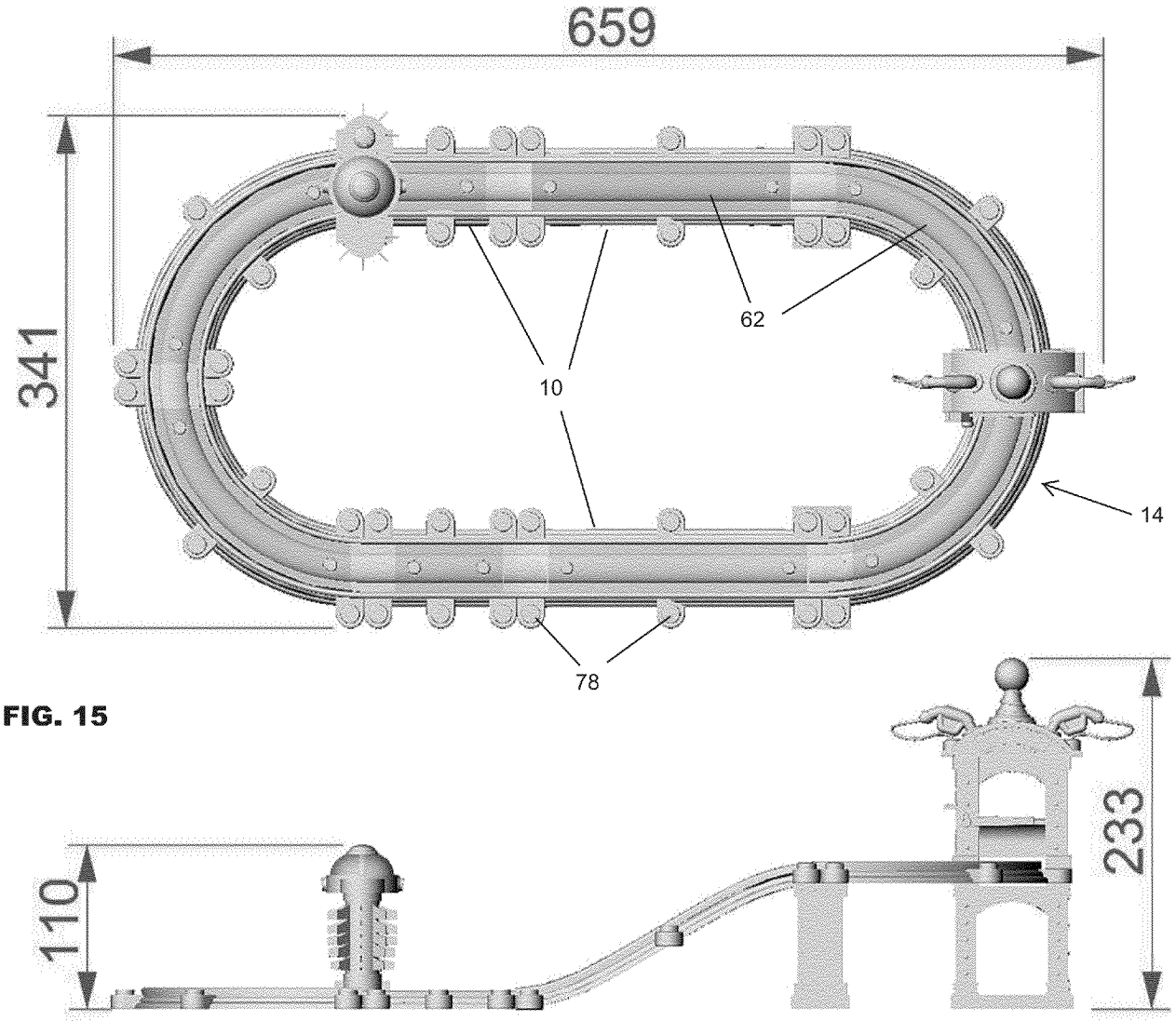
Figure 16:
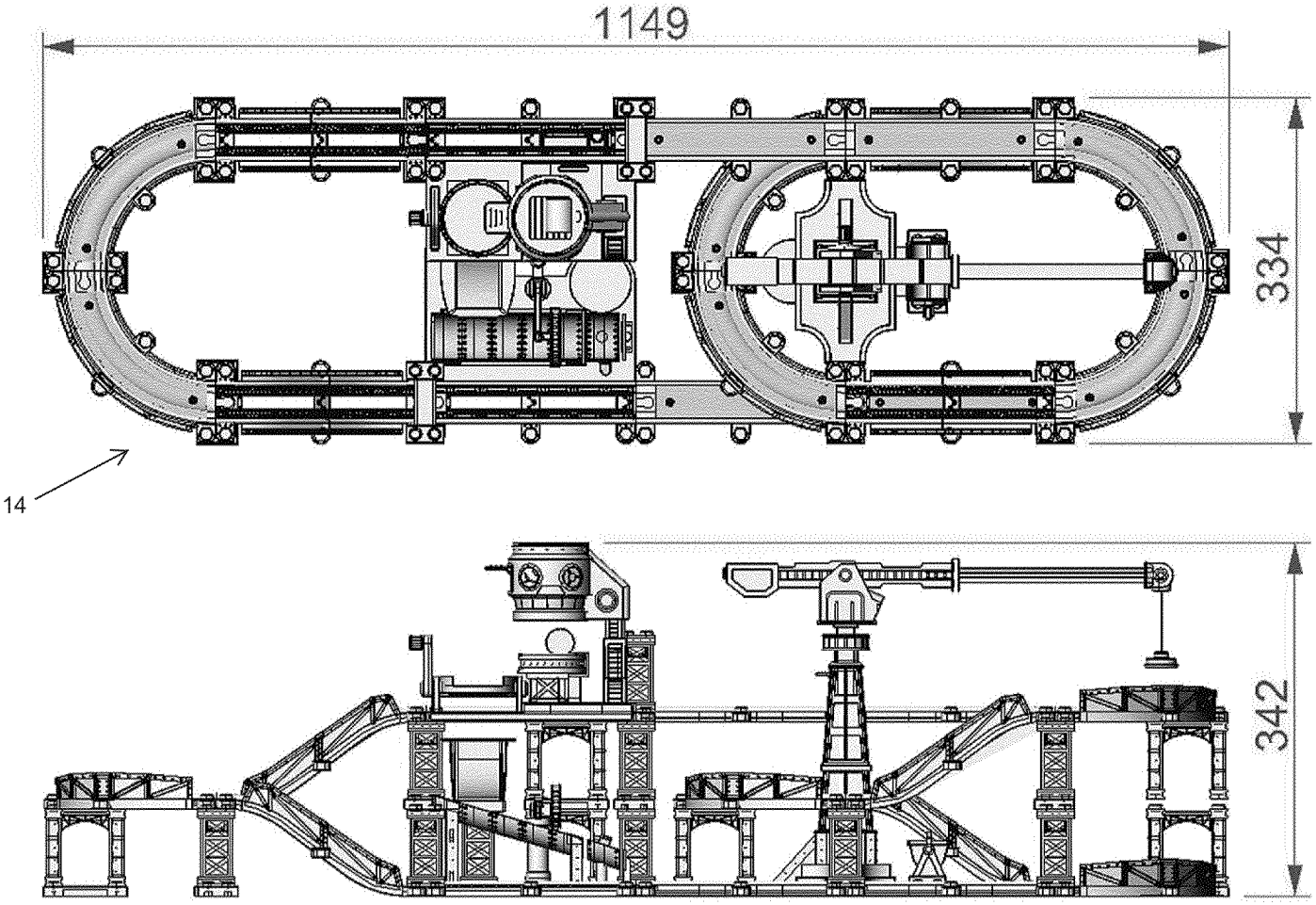
Figure 17:
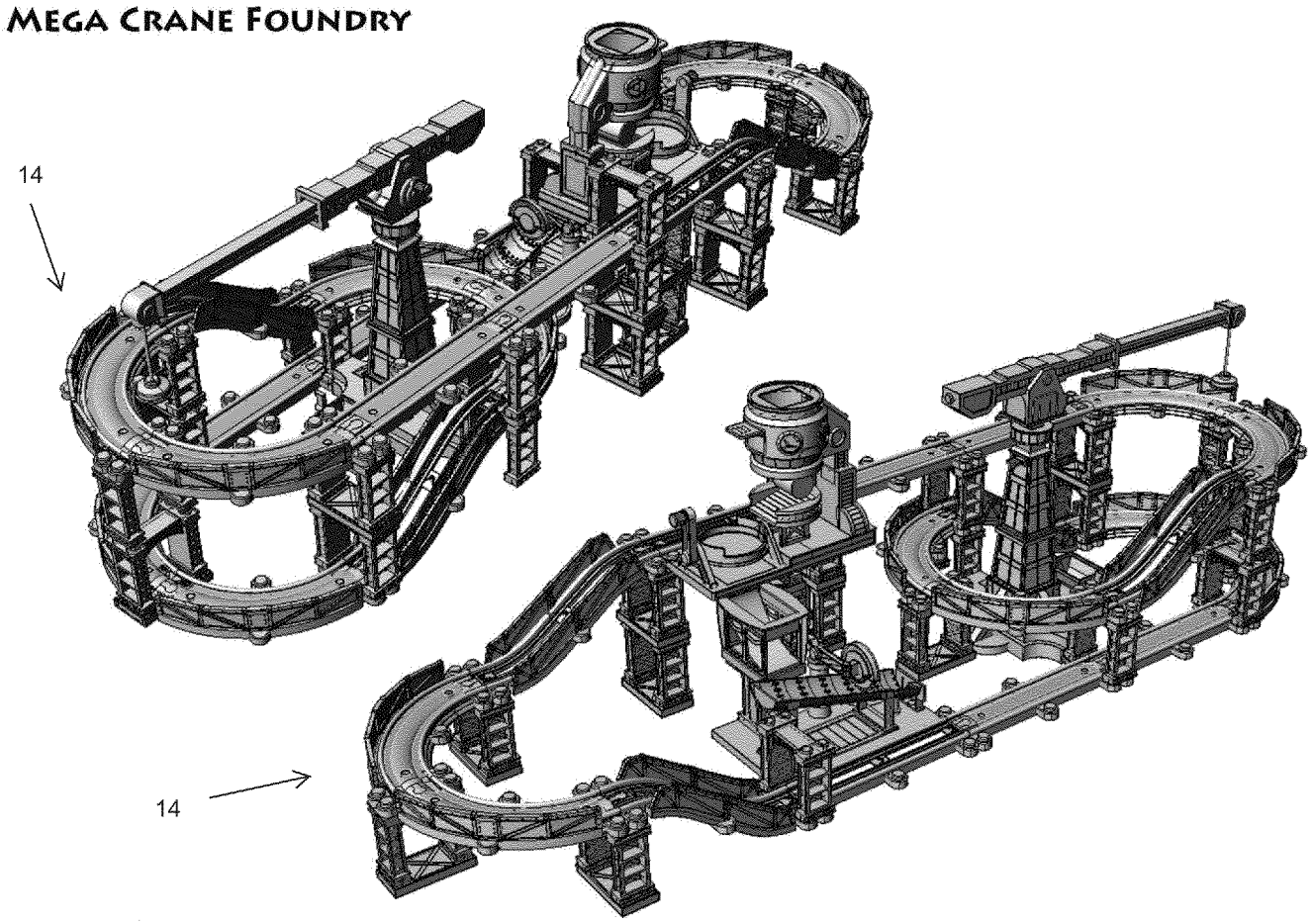
Figure 18:
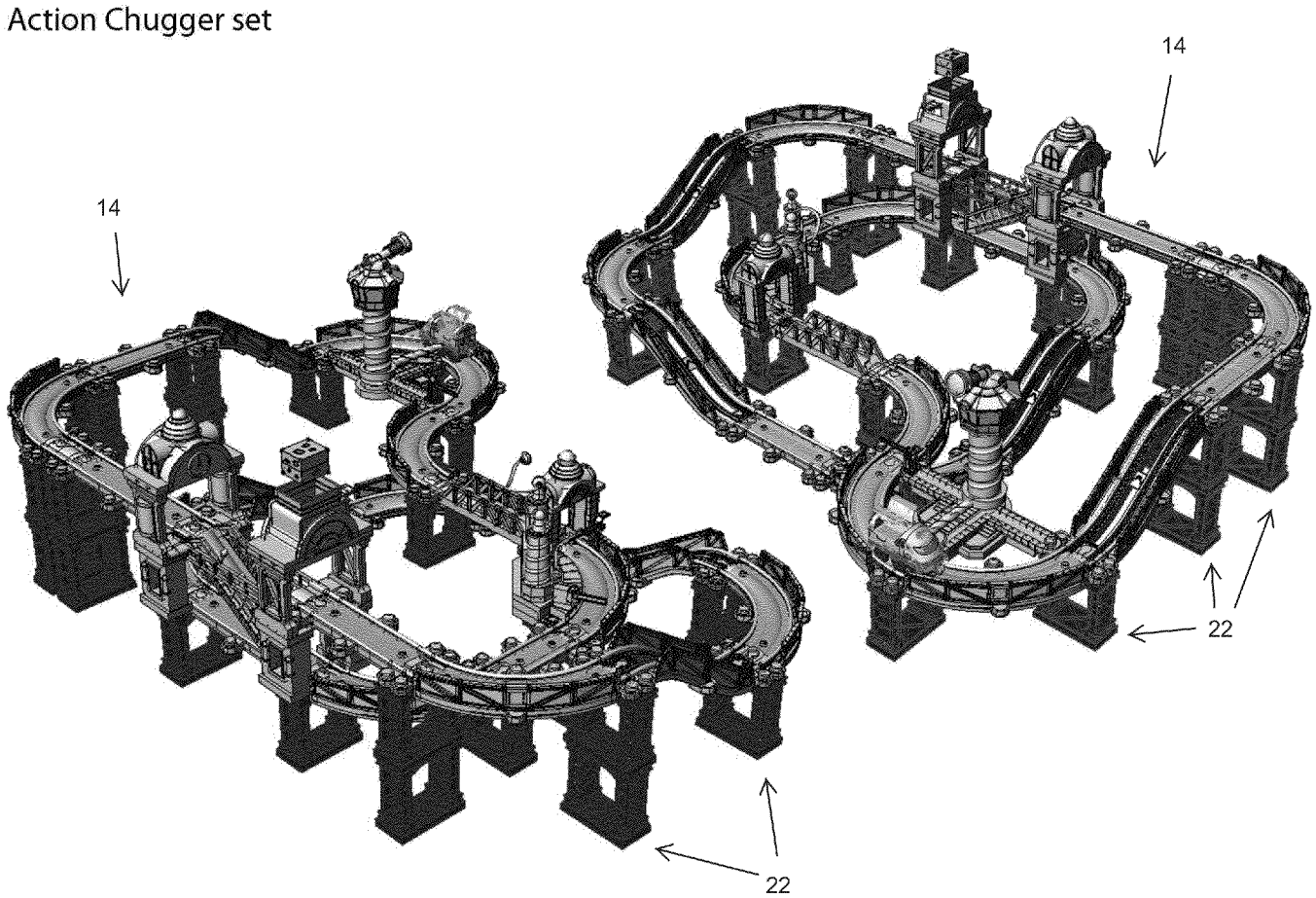
Figure 19:
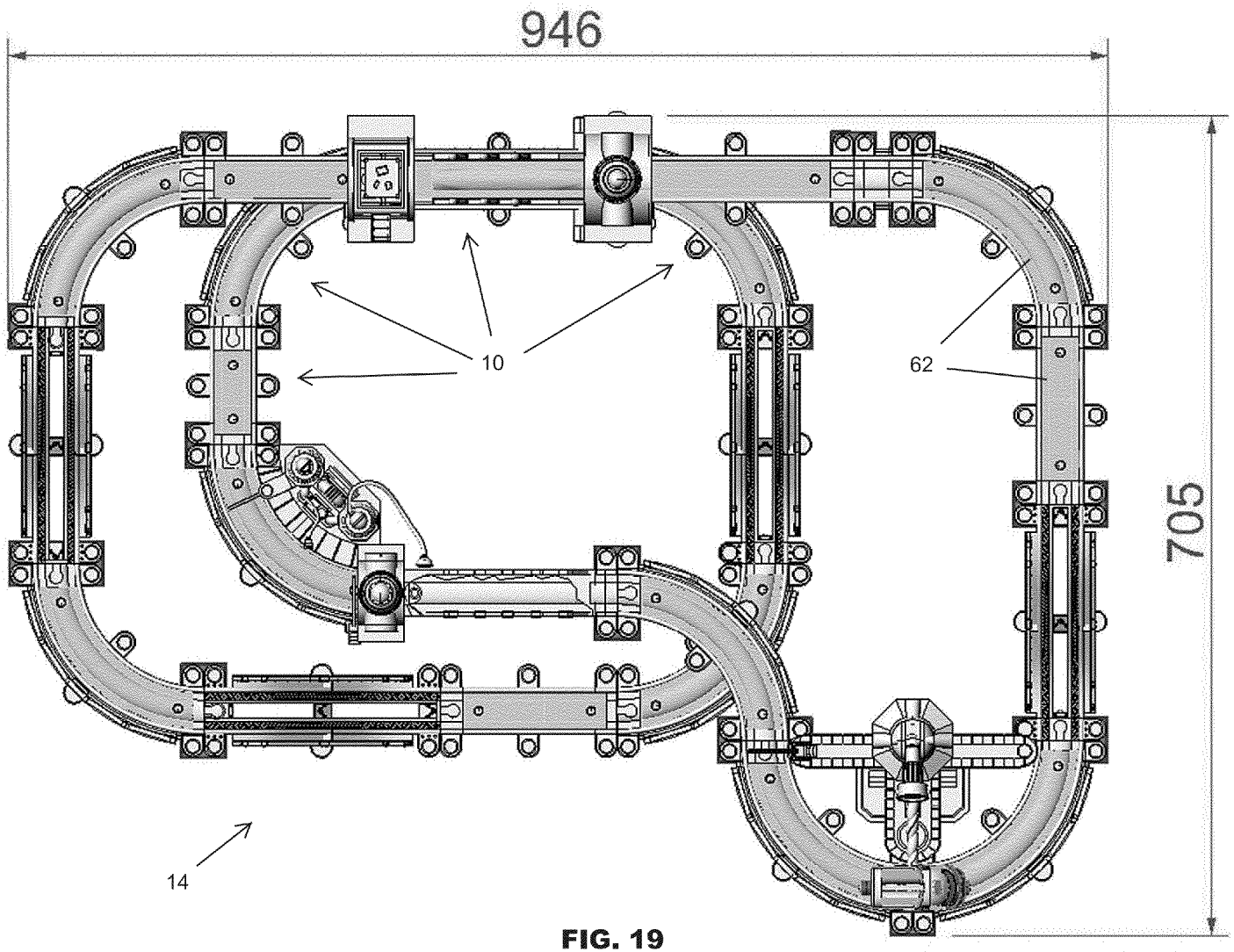
Figure 20:
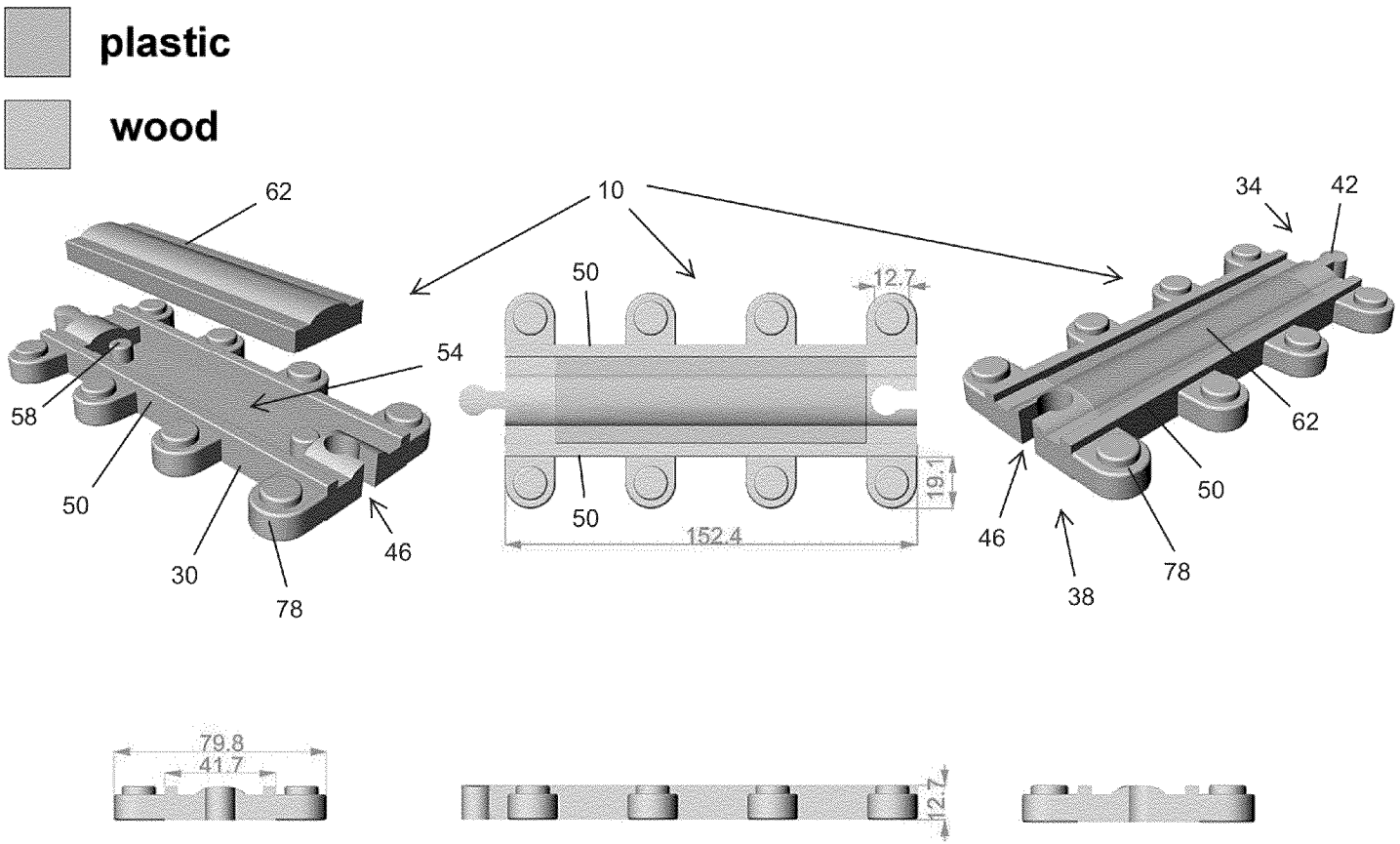
FIGS. 20-28 illustrate track pieces in a toy track system according to an embodiment of the invention.
Figure 21:
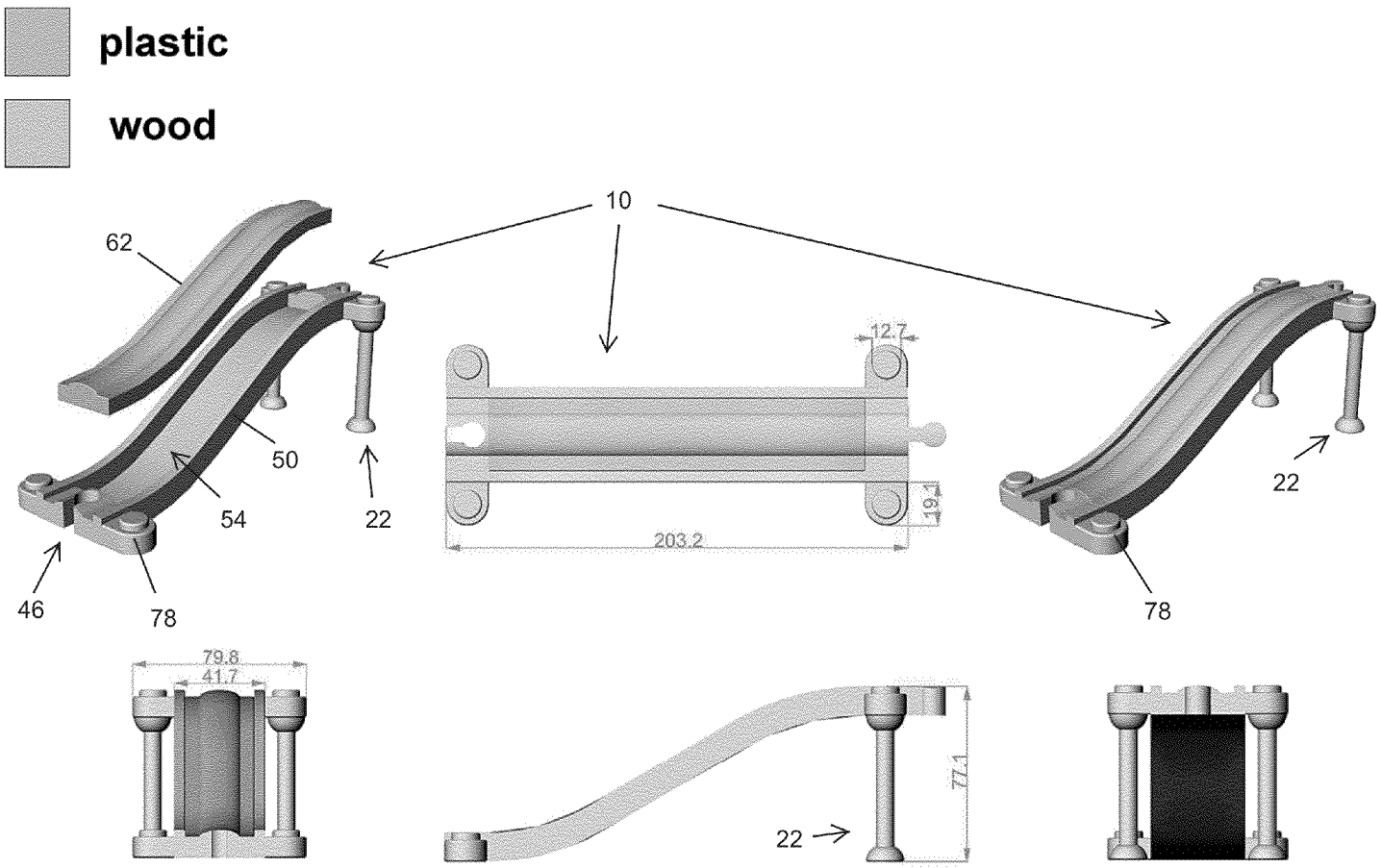
Figure 22:
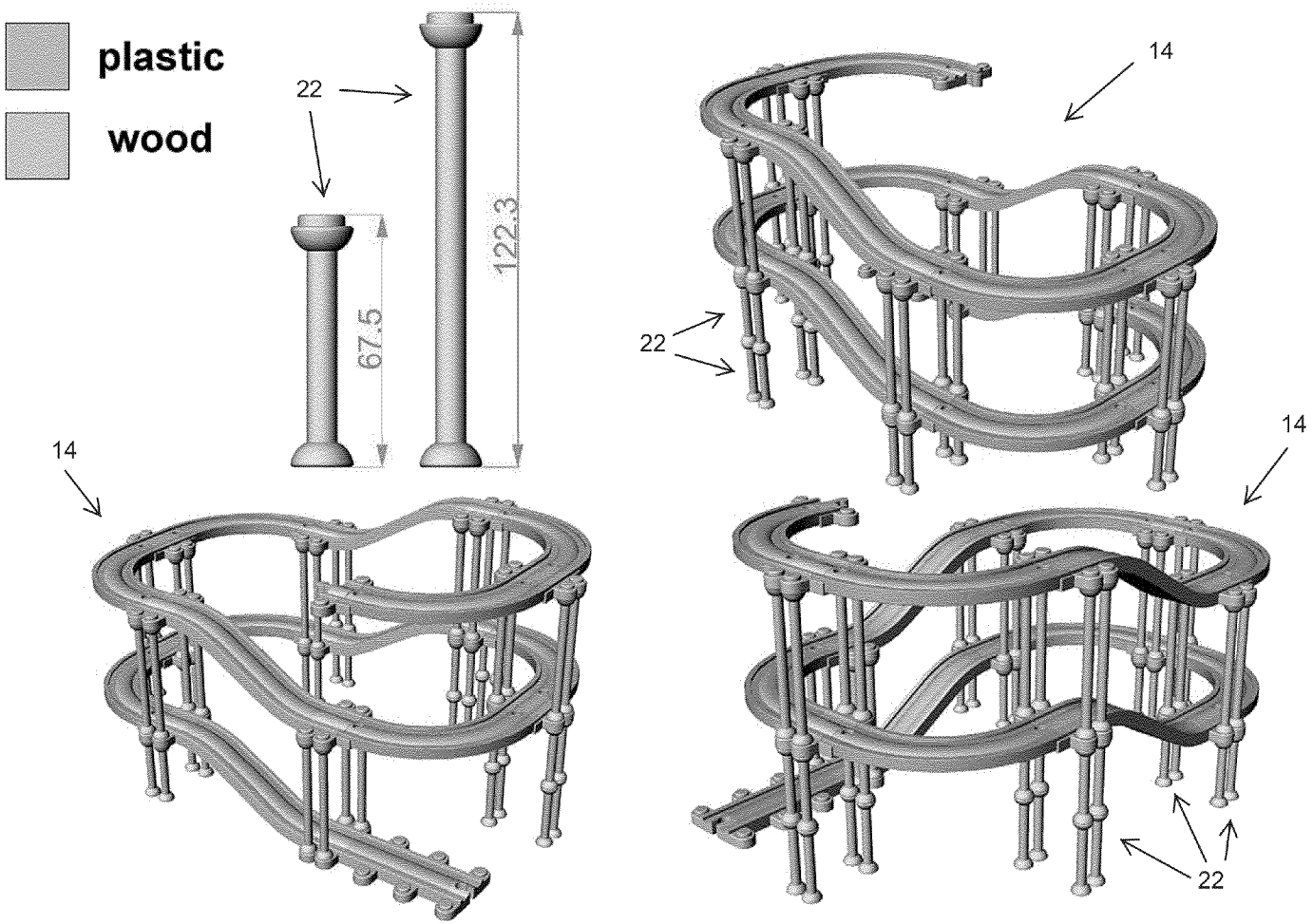
Figure 23:
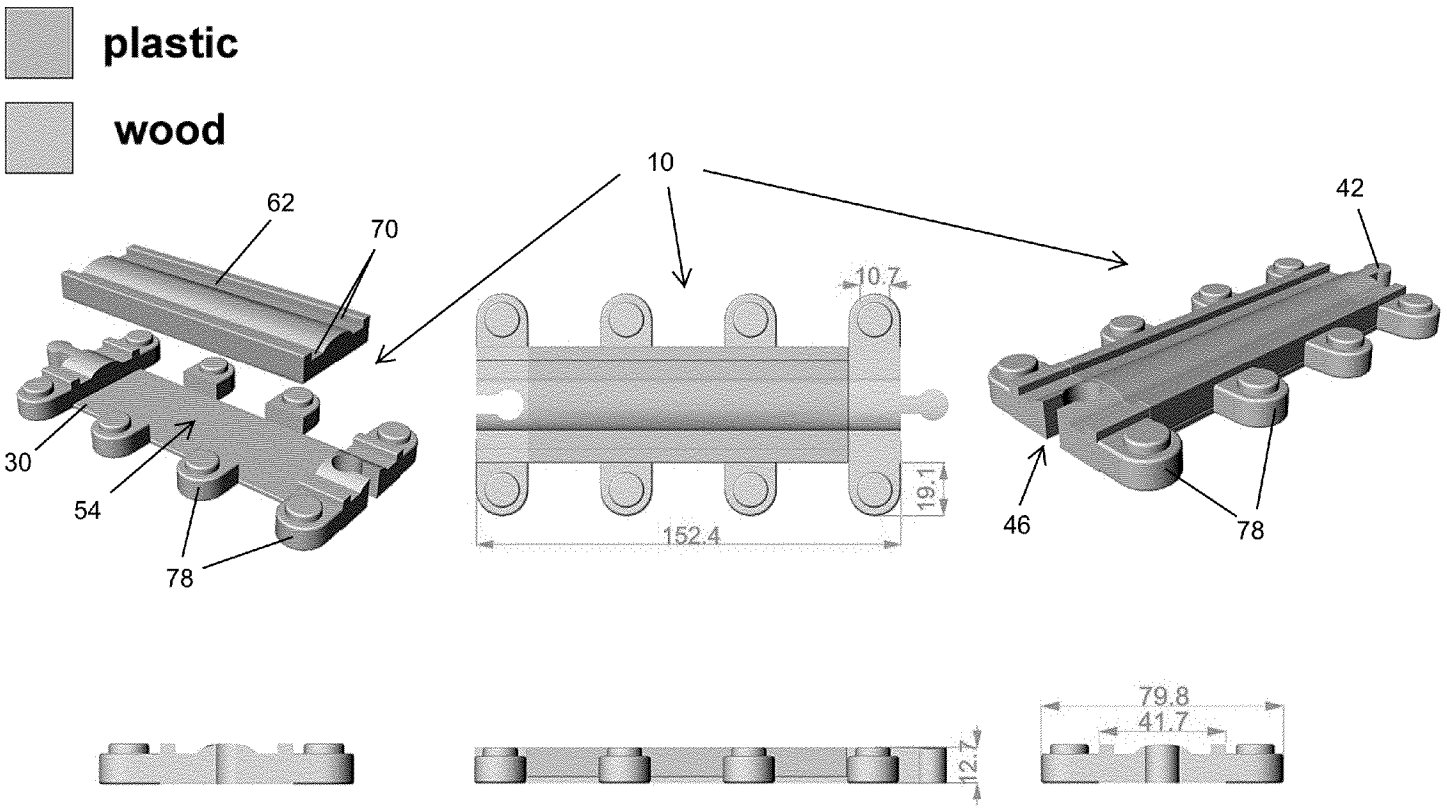
Figure 24:
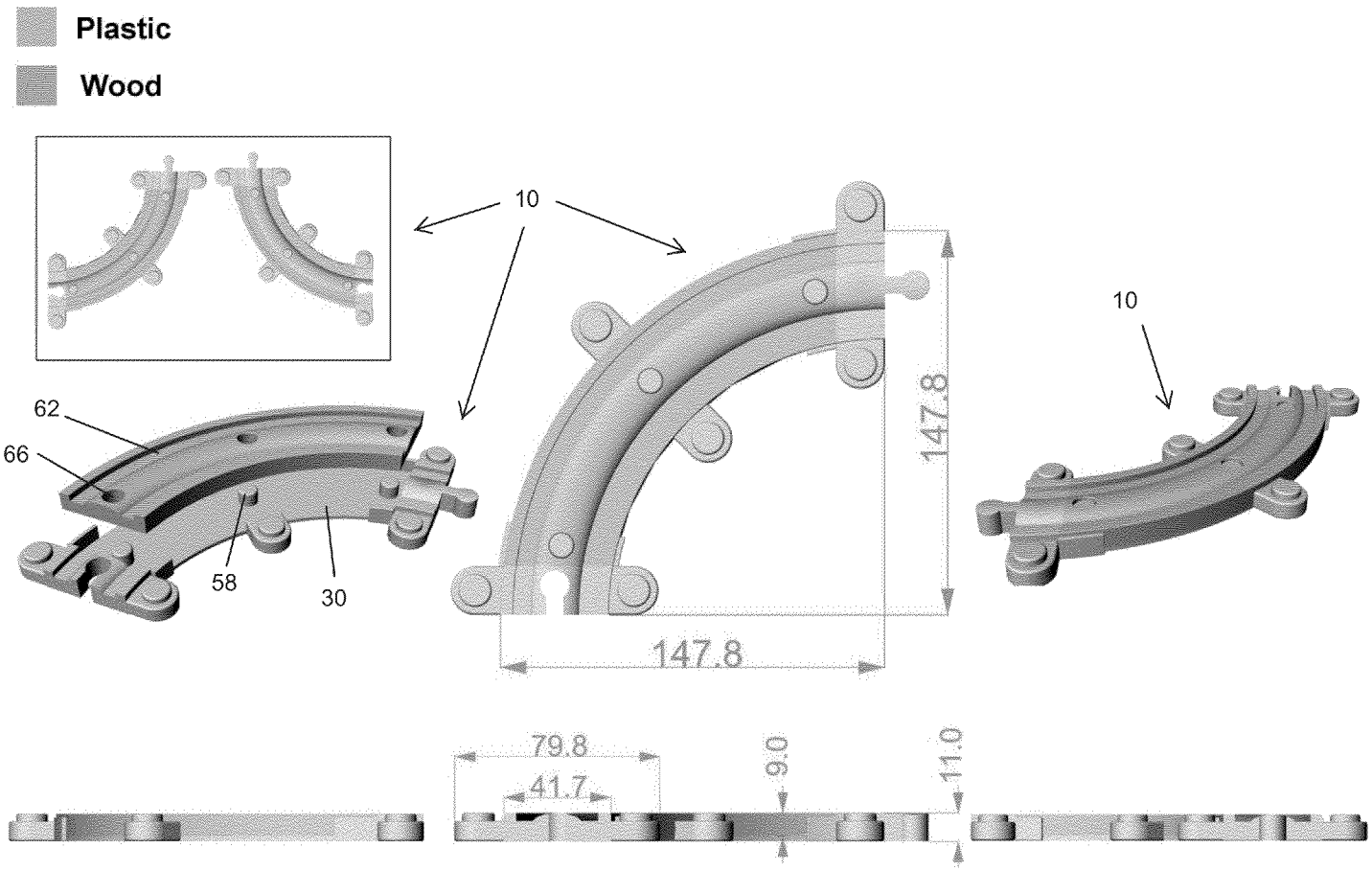
Figure 25:
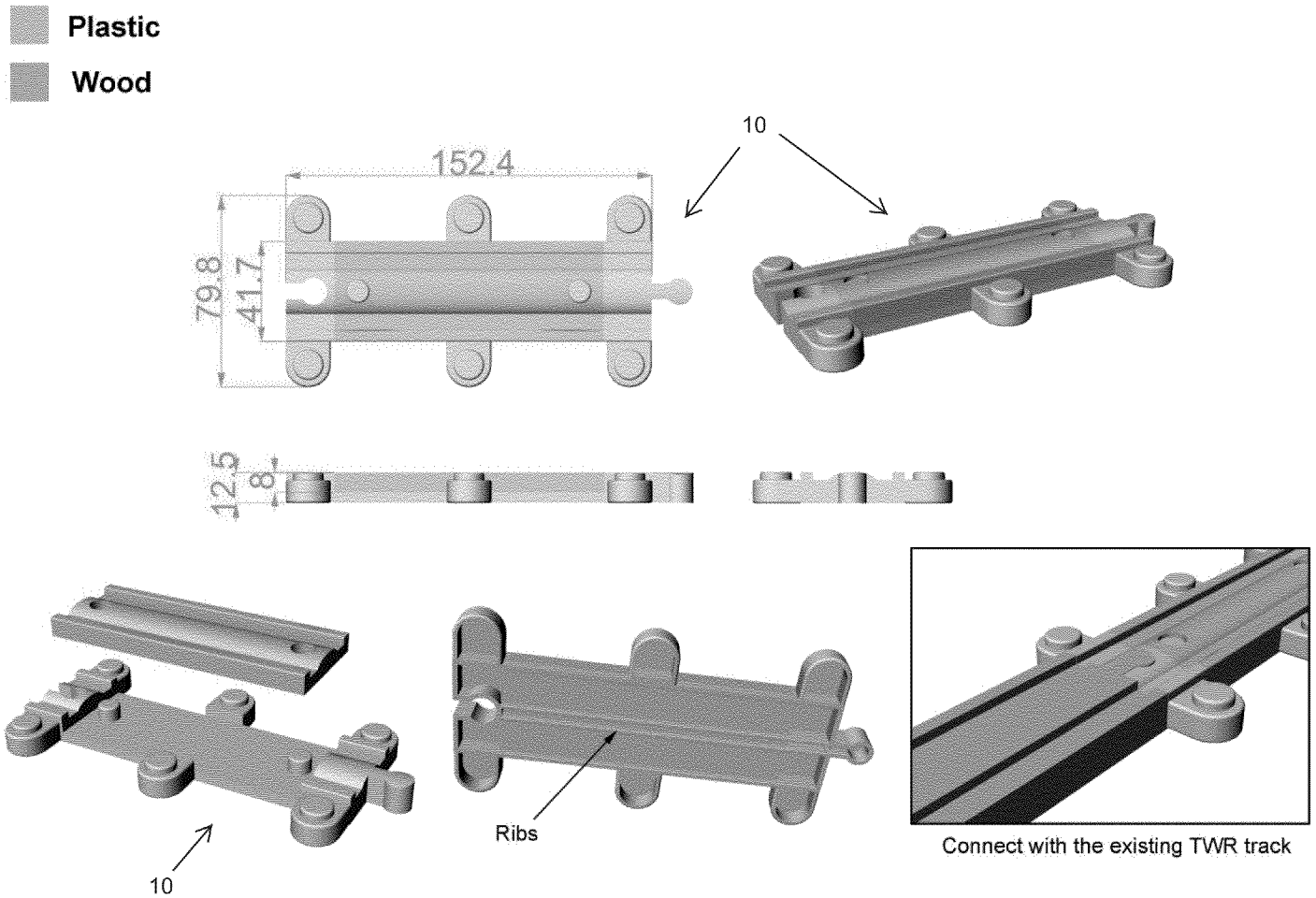
Figure 26:
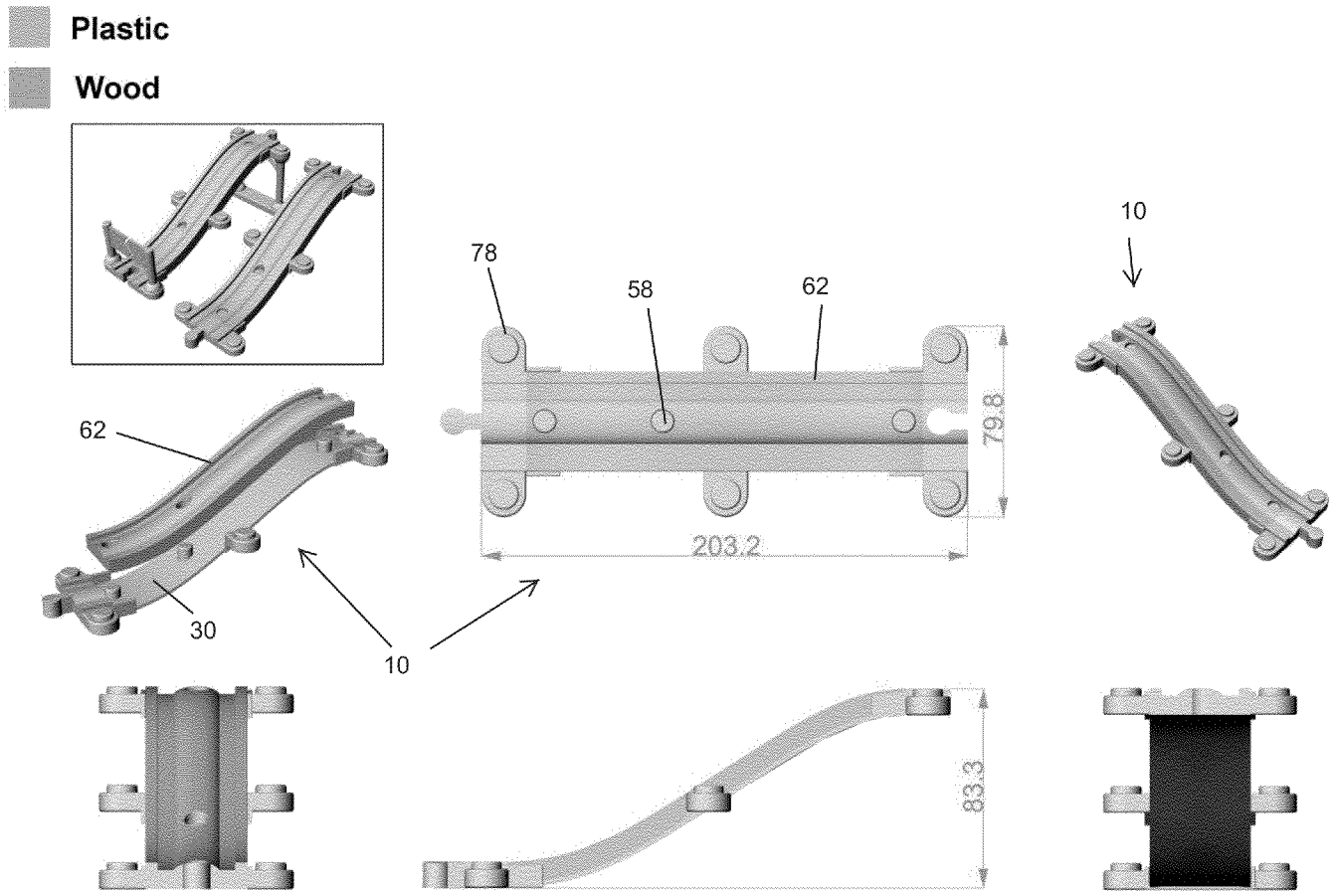
Figure 27:
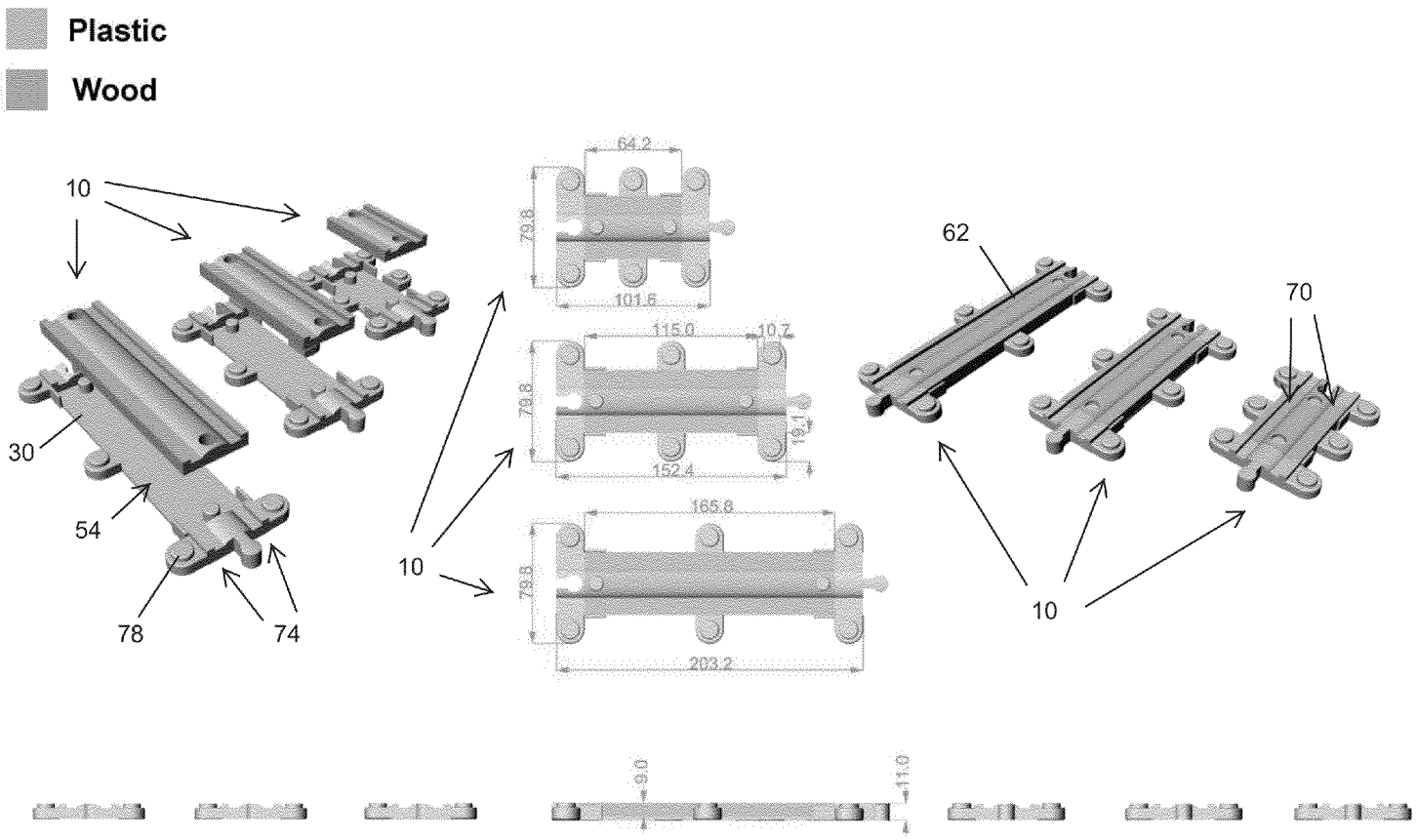
Figure 28:
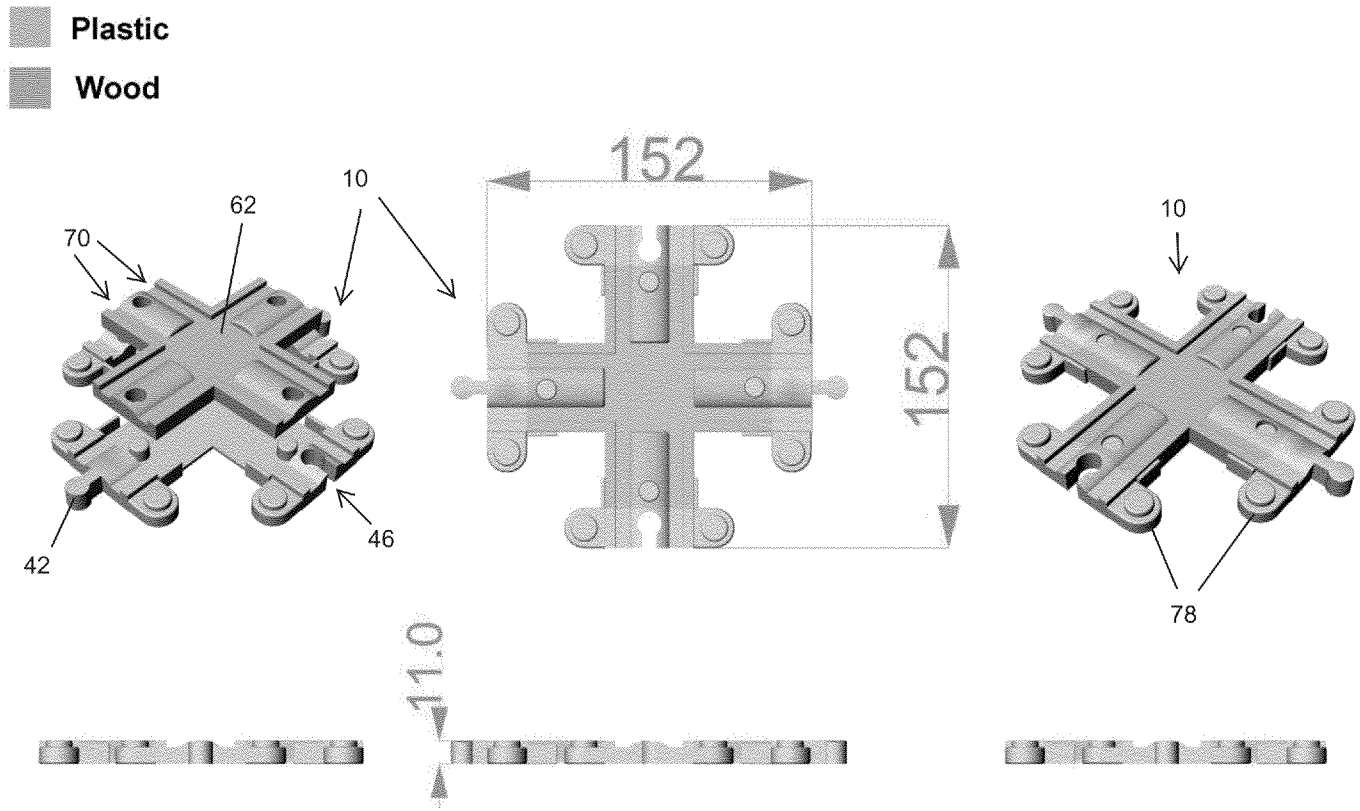
Figure 29:
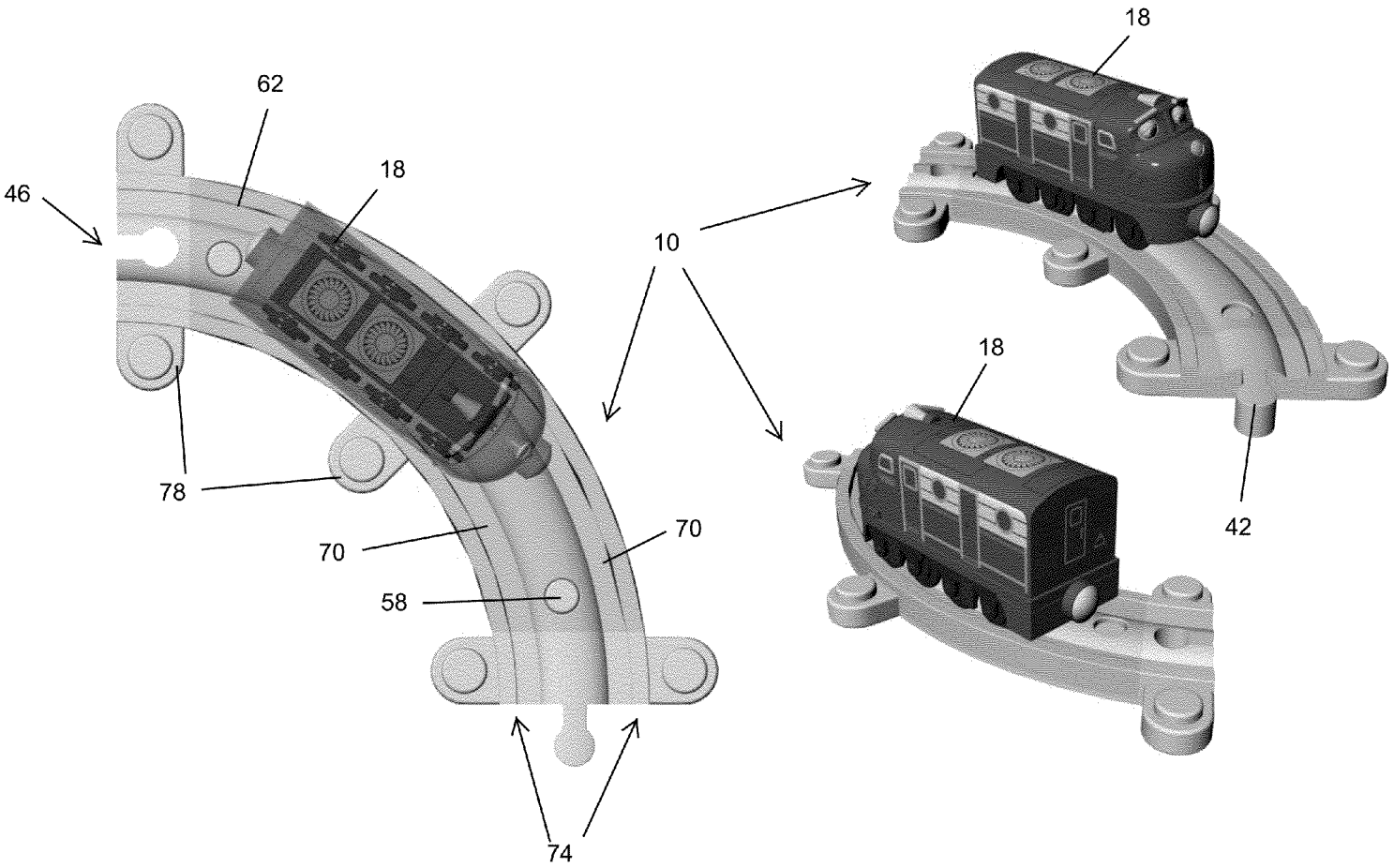
FIG. 29 illustrates several views of a vehicle traversing a track piece of the toy track system.
Figure 30:
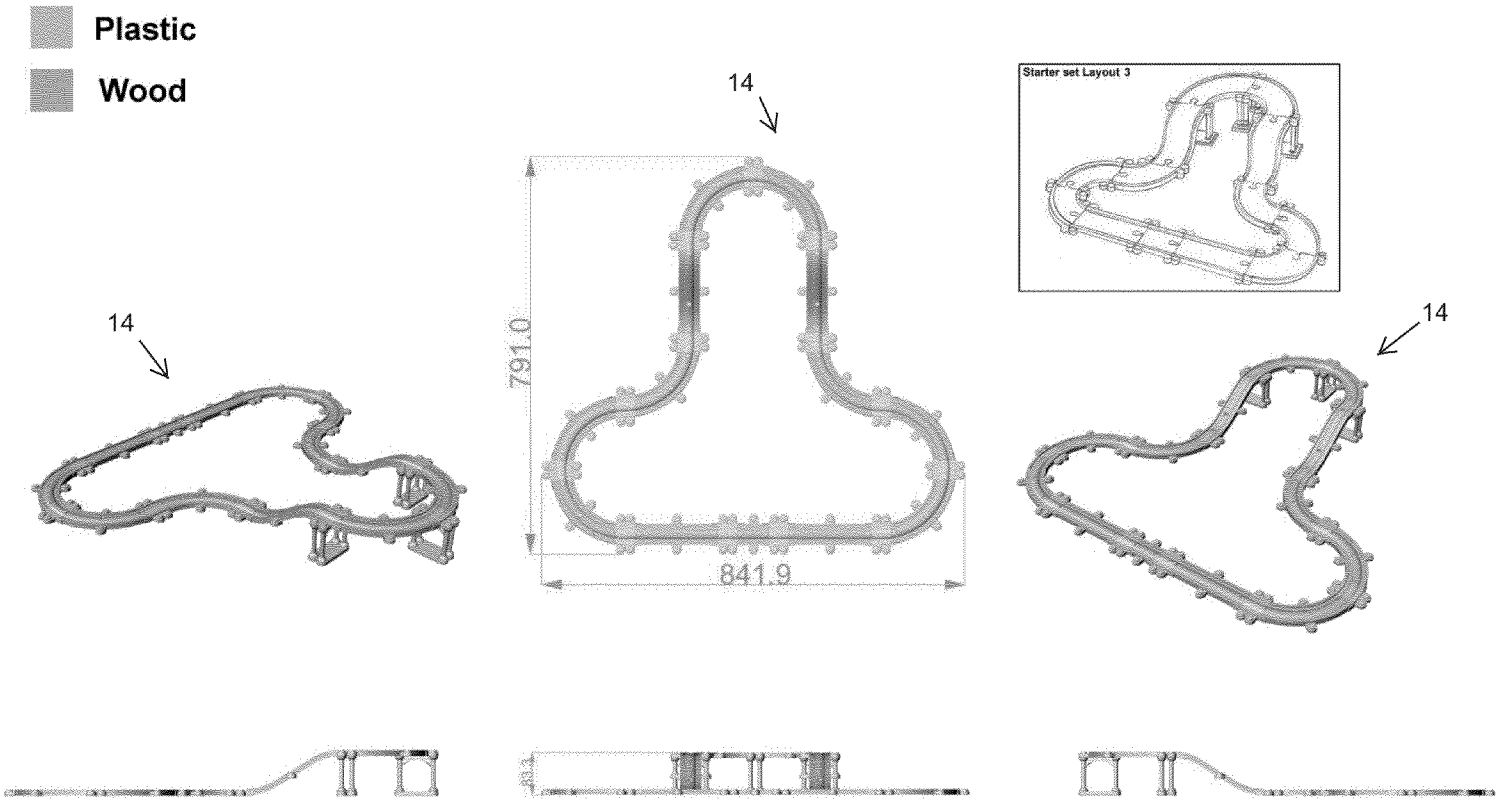
FIGS. 30-32 illustrate several views of a track layout formed with the toy track system.
Figure 31:
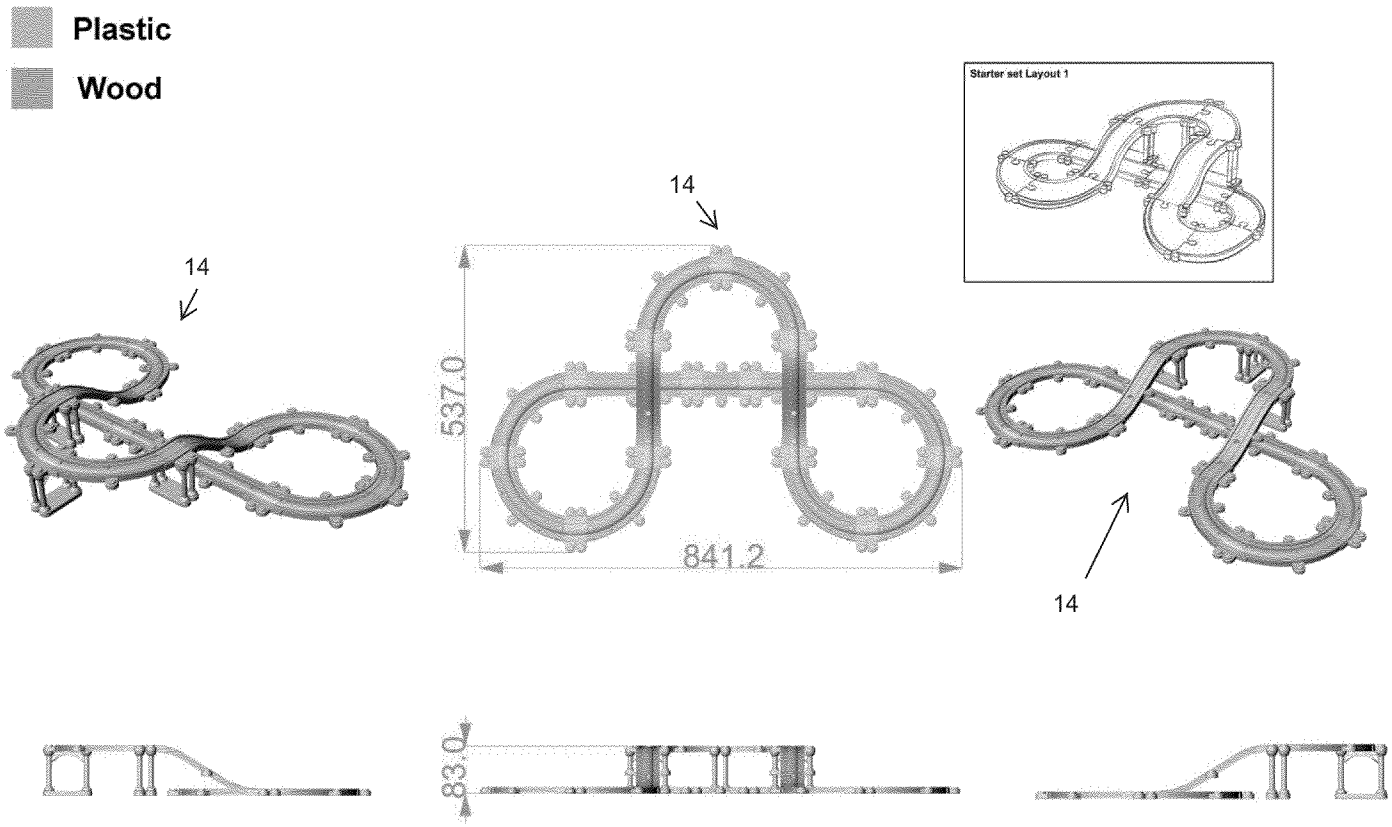
Figure 32:
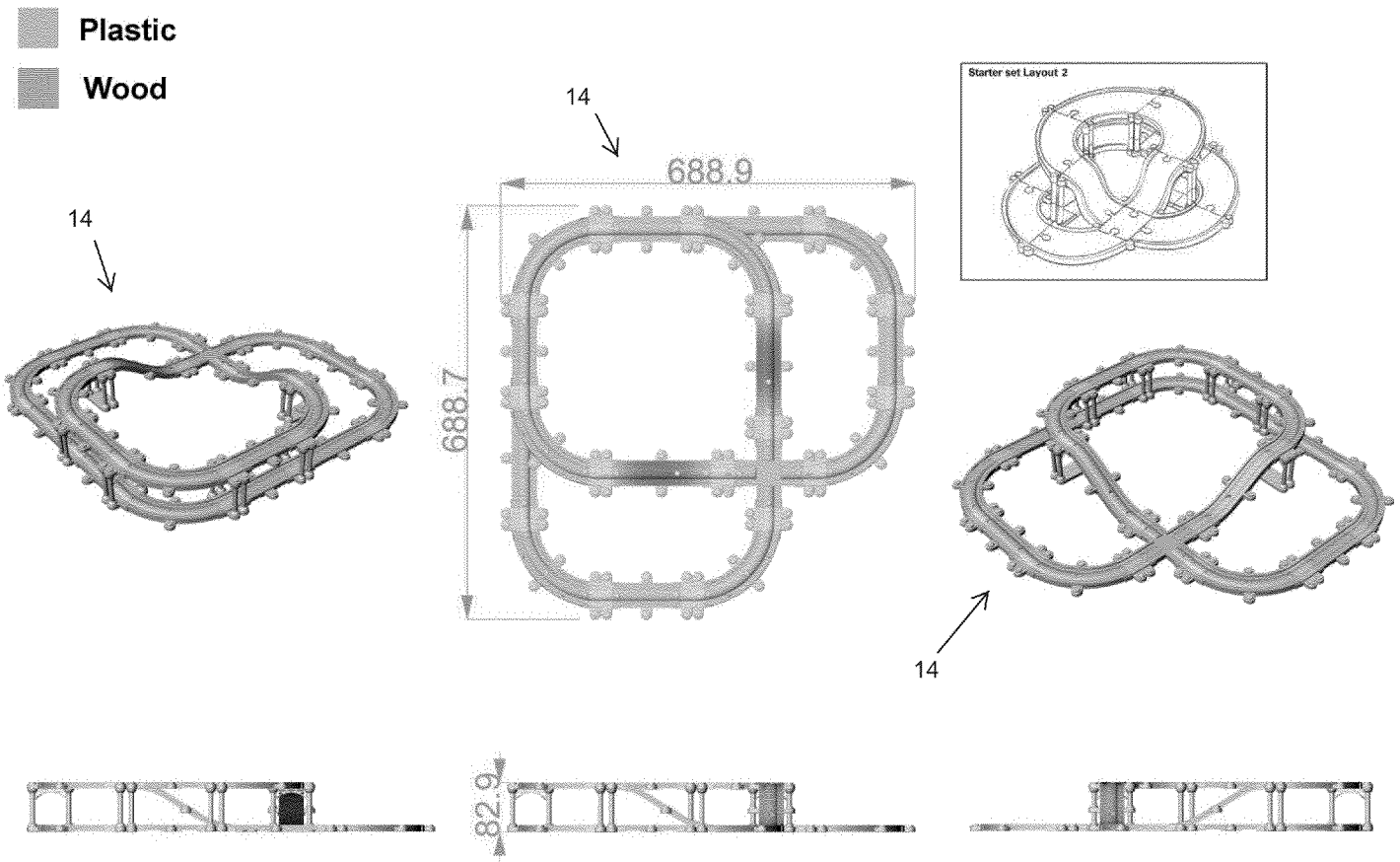

The track pieces 10 and the platforms 26 are geometrically dimensioned such that assembly of a particular track layout is modular. FIG. 11 illustrates this concept. The modularity of the track pieces 10 and the platforms 26 allows a user to easily build a sturdy and multi-level track layout.

Some of the track pieces 10 illustrated in FIGS. 1-7 and 20-21 include a base 30 having a first end 34 and a second end 38. The first end 34 includes a male connector 42, and the second end 38 includes a female connector 46. One or more sidewalls 50 extend upward from the base 30 and can extend the length between the first end 34 and the second end 38. The base 30, the first end 34, the second end 38, and the sidewalls 50 define a recess 54. The recess 54 can include one or more posts 58 extending upward from the base 30. The recess 54 is configured to receive a track surface 62, but is not required. The track surface 62 can comprise a material different than the material of the base 30. In one construction, the track surface comprises a wood material. Other suitable materials are also contemplated by the invention. The track surface 62 can include one or more apertures 66 configured to receive the one or more posts 58. The track surface 62 is contoured to form a pair of channels 70 where the wheels of the vehicle traverse. The first end 34 and the second end 38 similarly include a pair of channels 74 aligned with the channels 70 to provide a continuous path for the vehicle. Some of the track pieces 10 also include a plurality of male connection points 78 extending from the sidewalls 50. These male connection points 78 are configured to receive a corresponding female connector of a platform 26, support piece 22, or a destination/playset.

Figure 1:
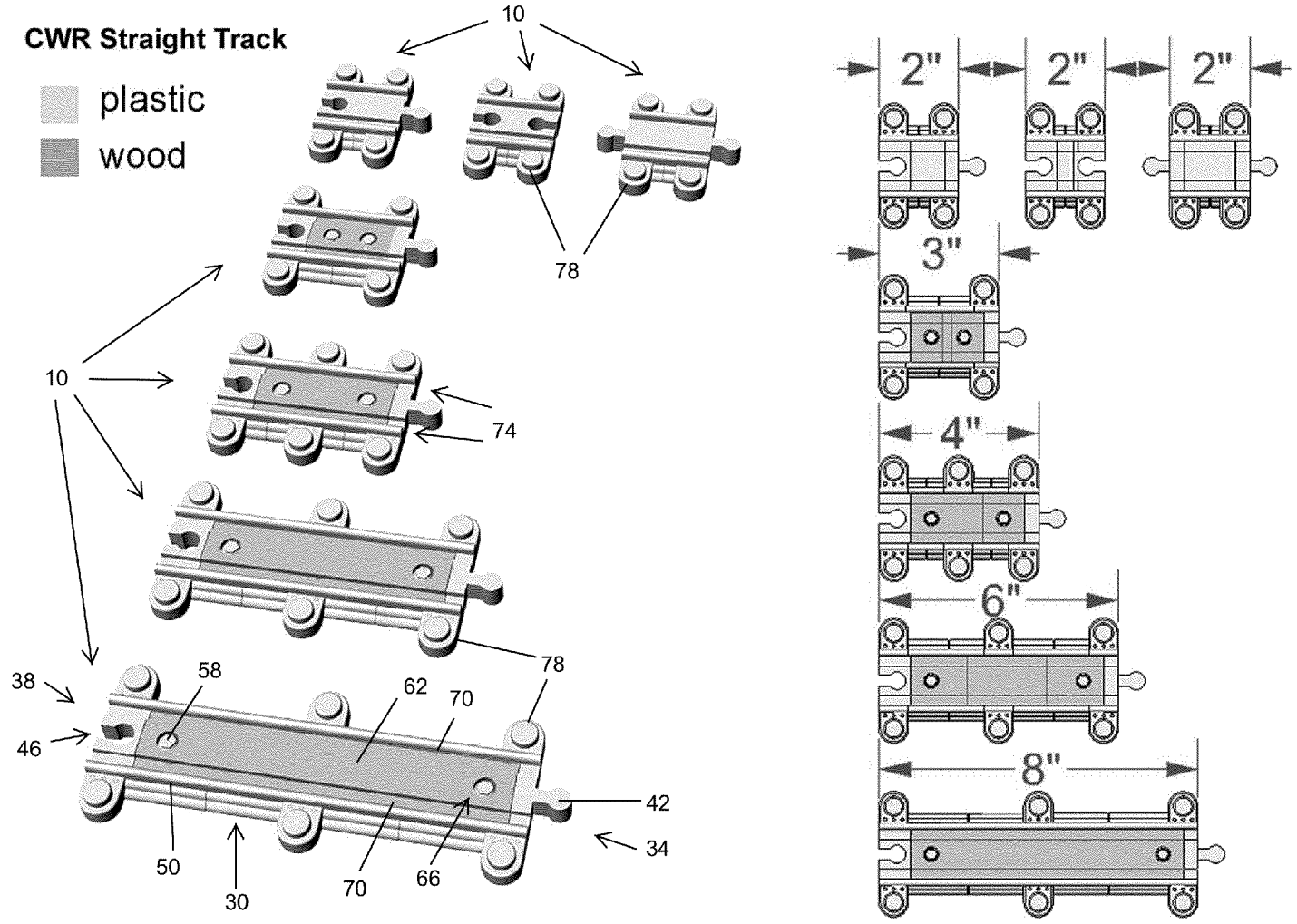
FIGS. 1-7 illustrate track pieces in a toy track system according to an embodiment of the invention.
Figure 2:
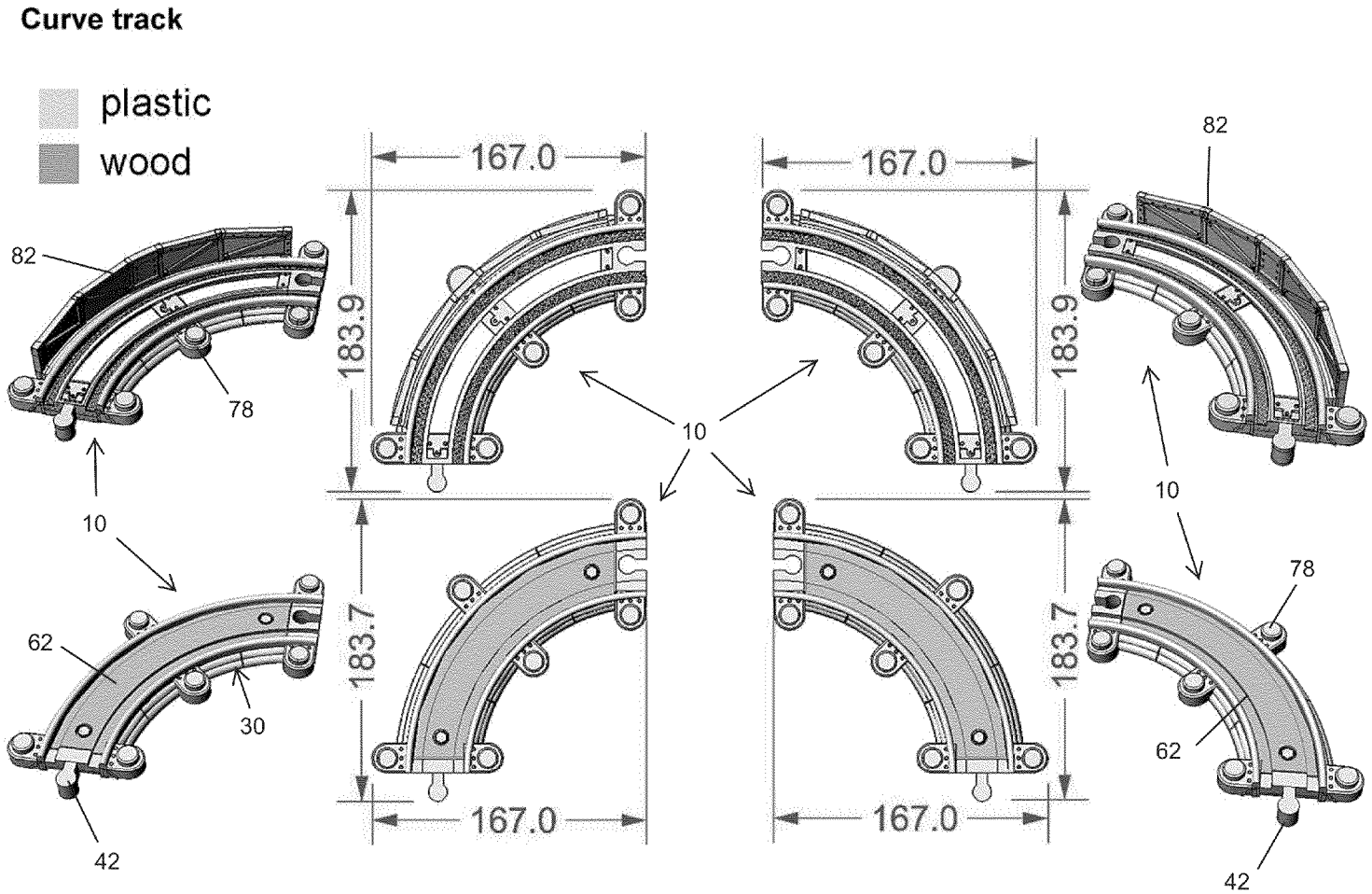
Figure 3:
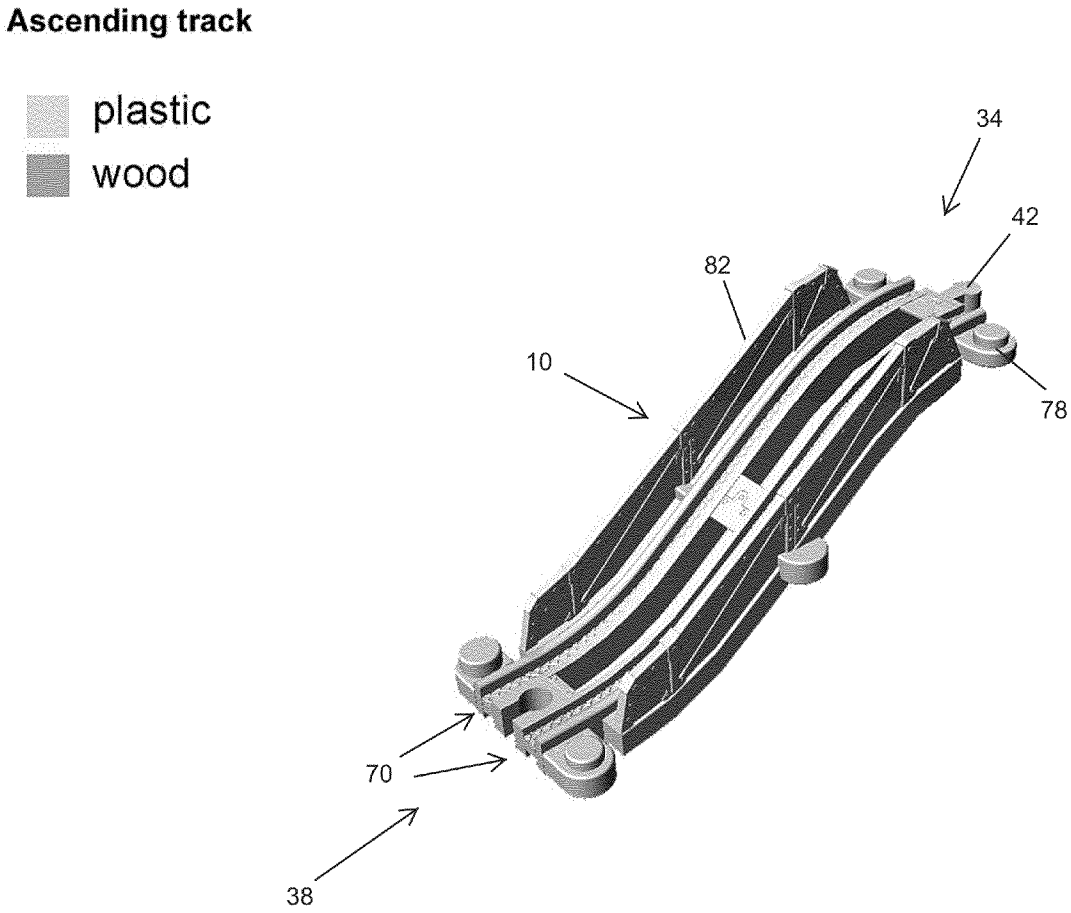
Figure 4:
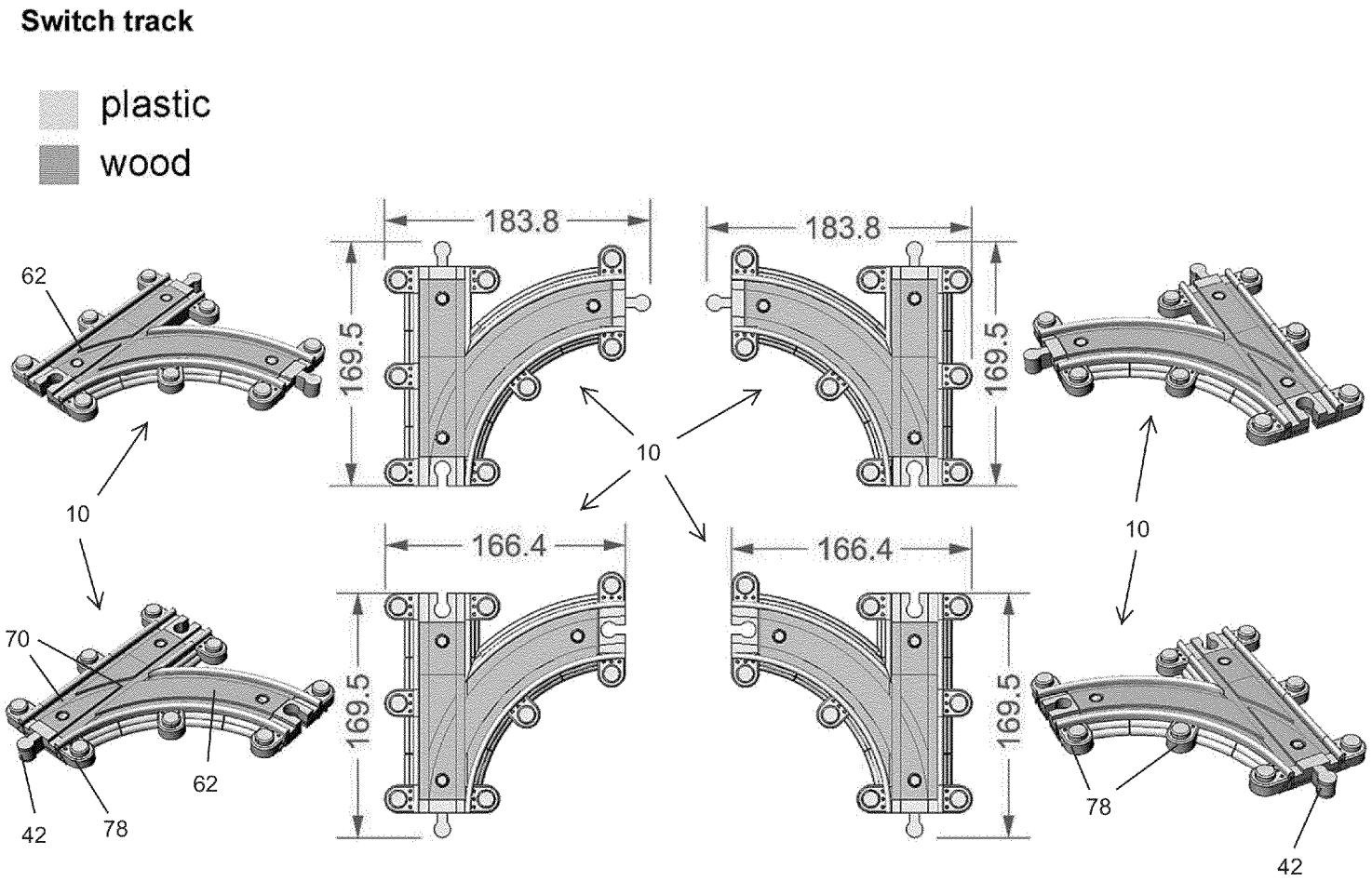
Figure 5:
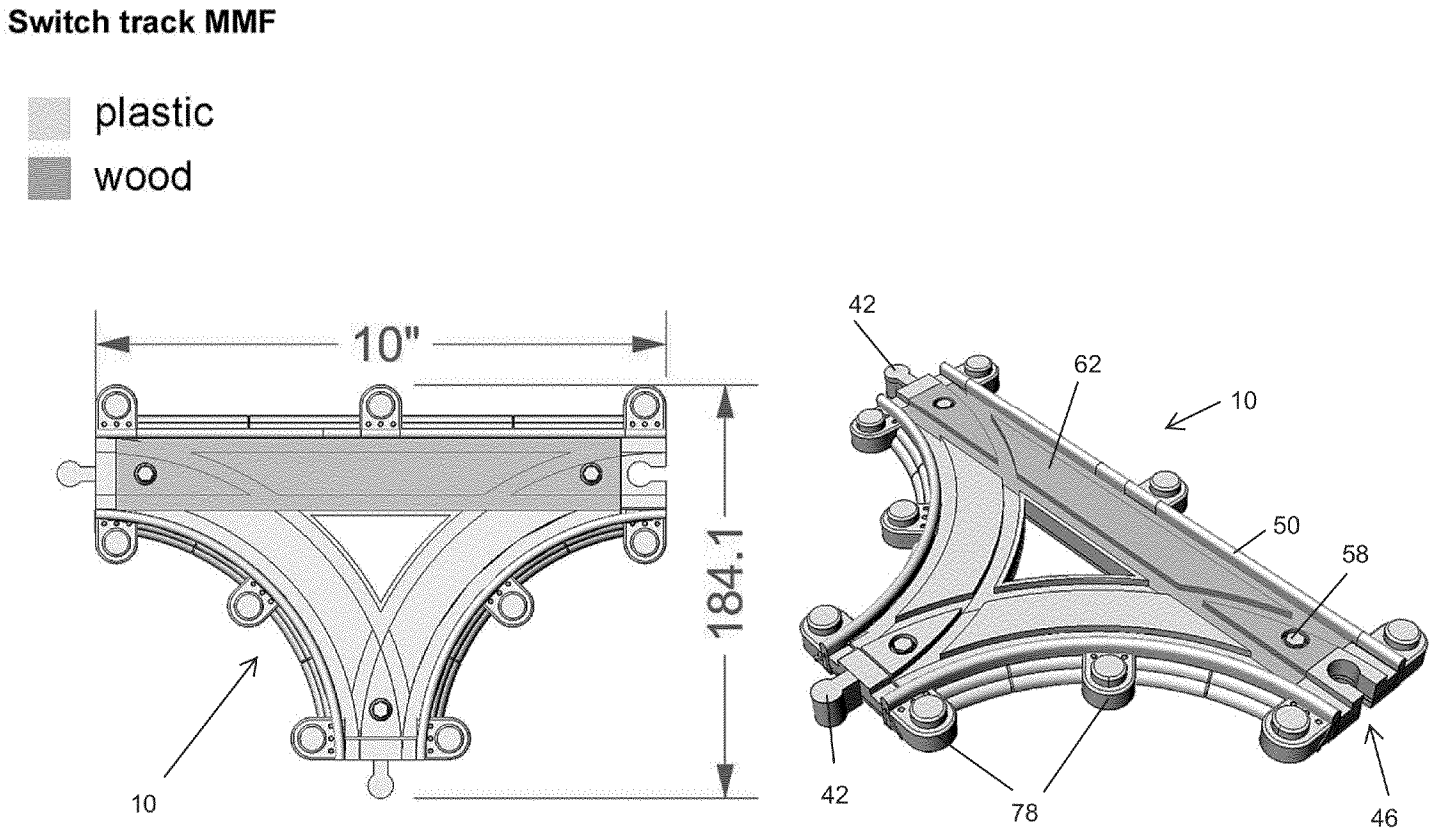
Figure 6:
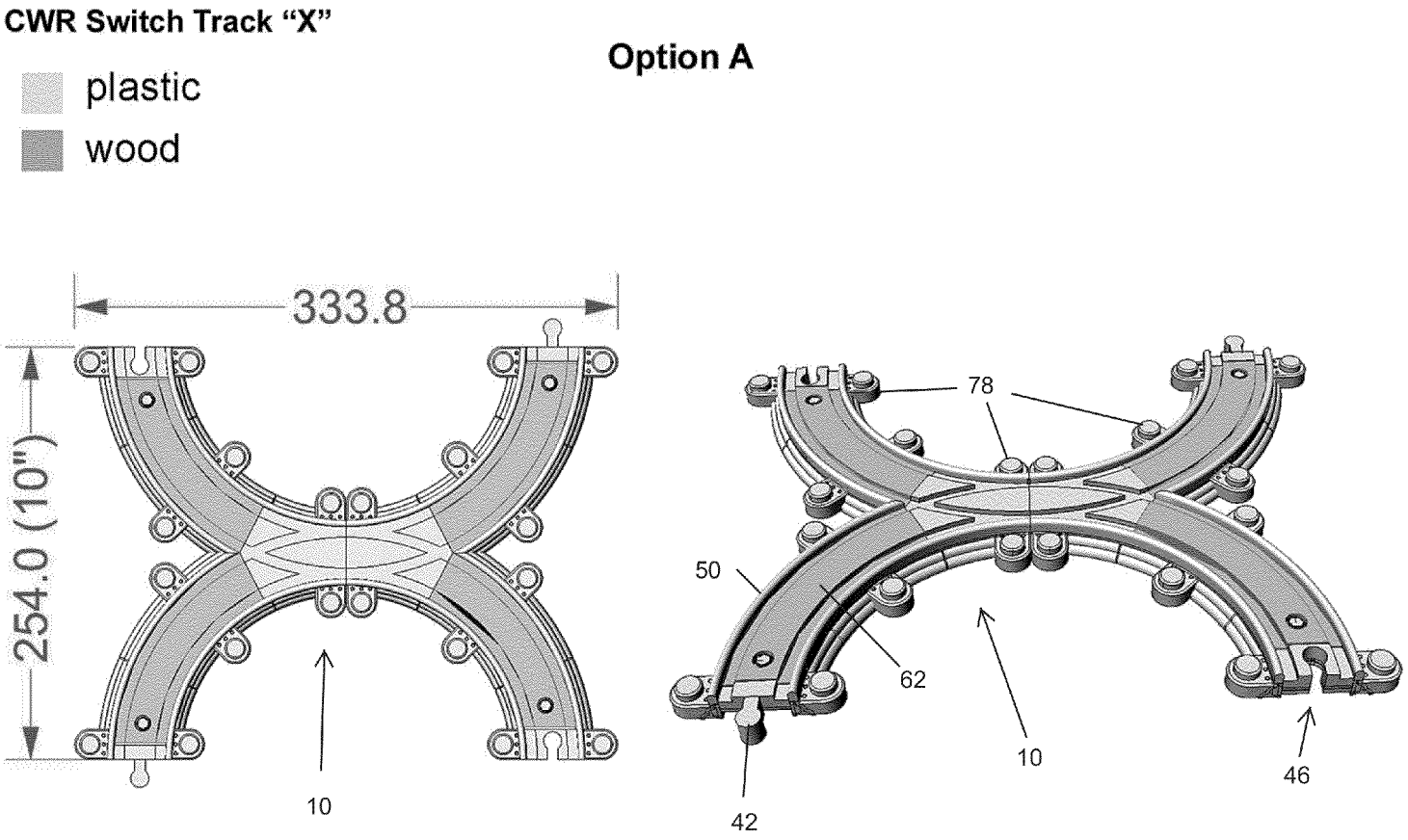
Figure 7:
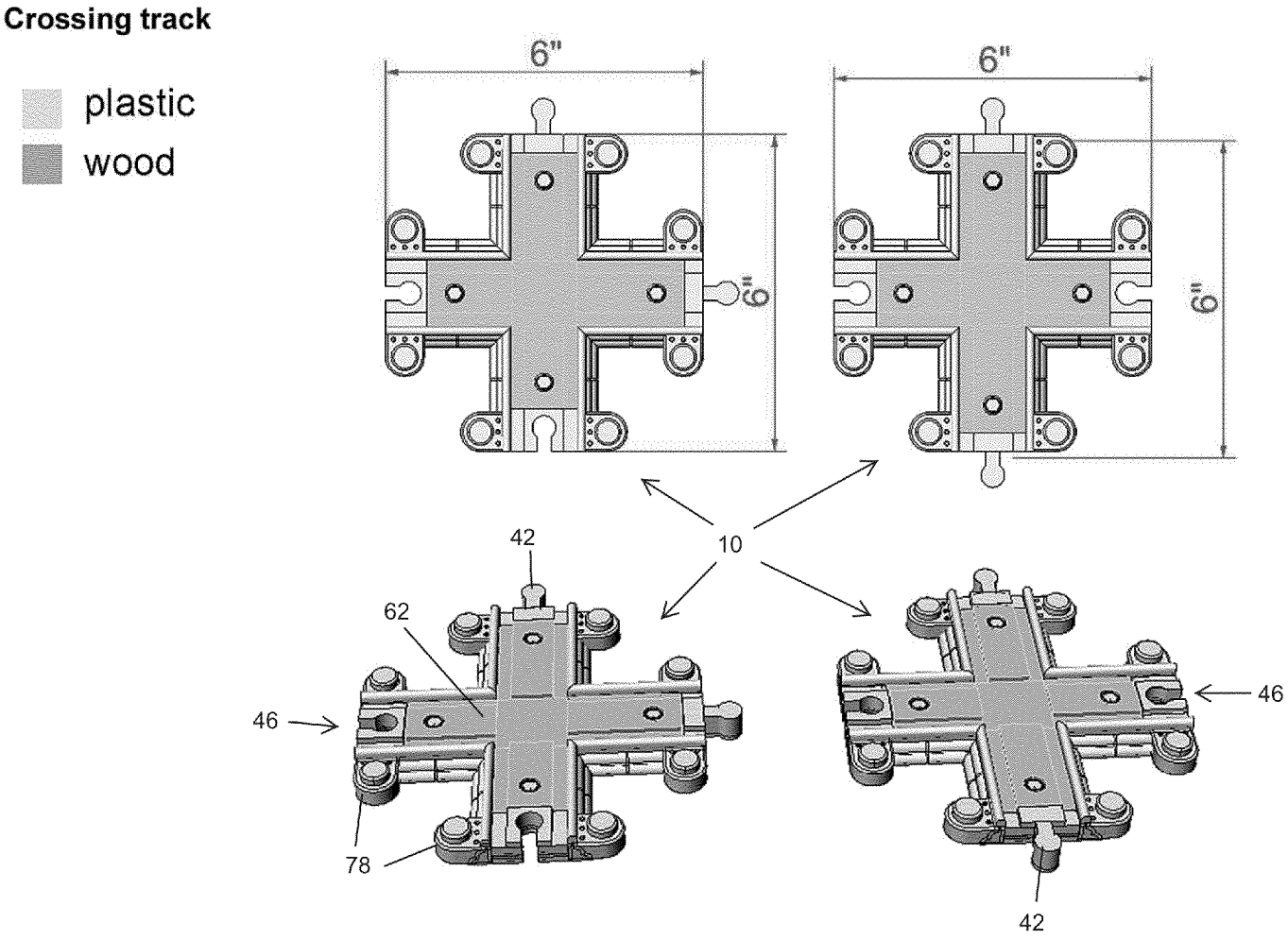

As illustrated in FIG. 2, some of the track pieces 10 can include an extended sidewall 82 to further support a vehicle traversing a hill, or traversing around a corner or bend and to prevent the vehicle from falling off the track.

Figure 8:
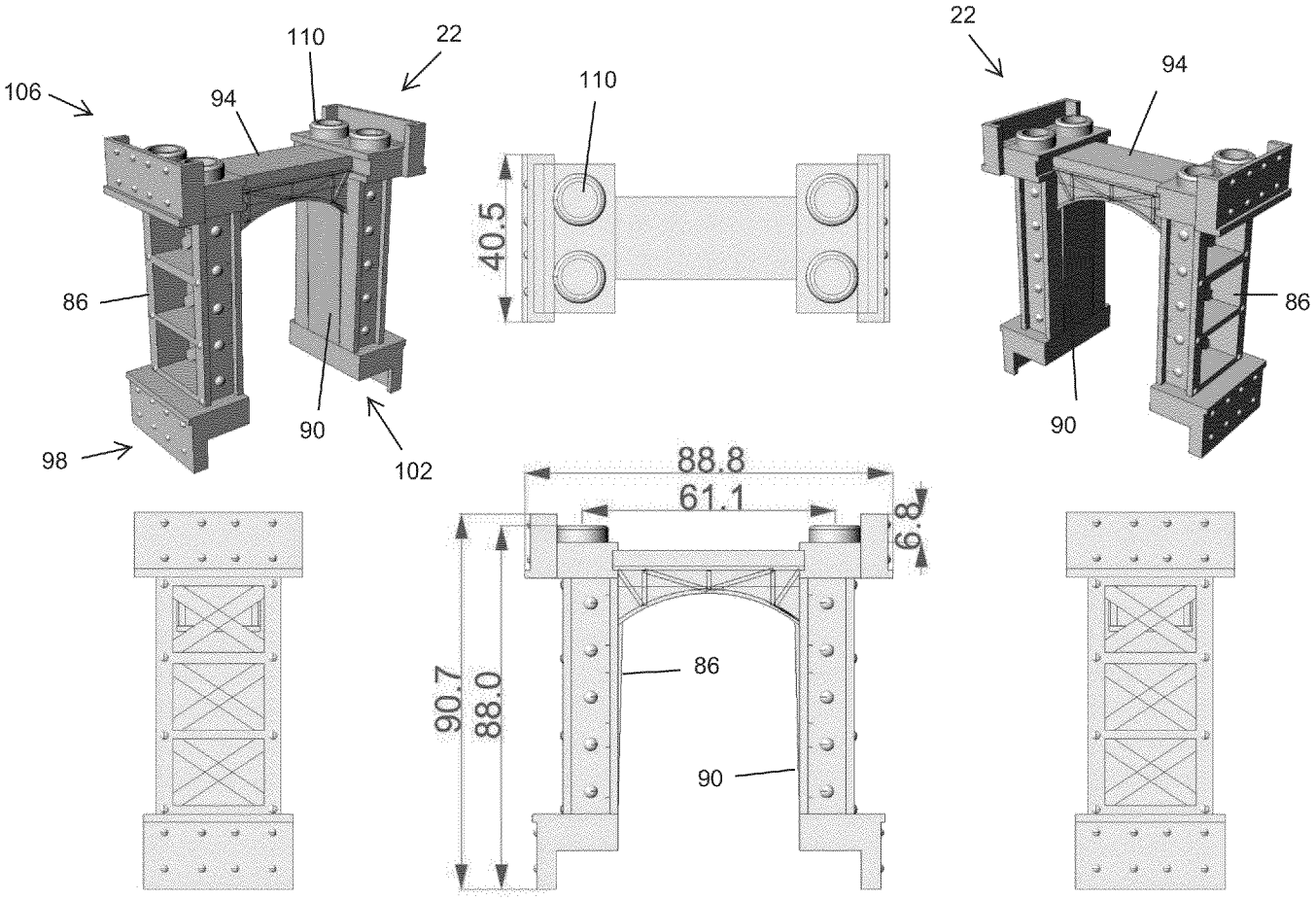
FIGS. 8-10 illustrate support pieces in a toy track system according to an embodiment of the invention.
Figure 9:
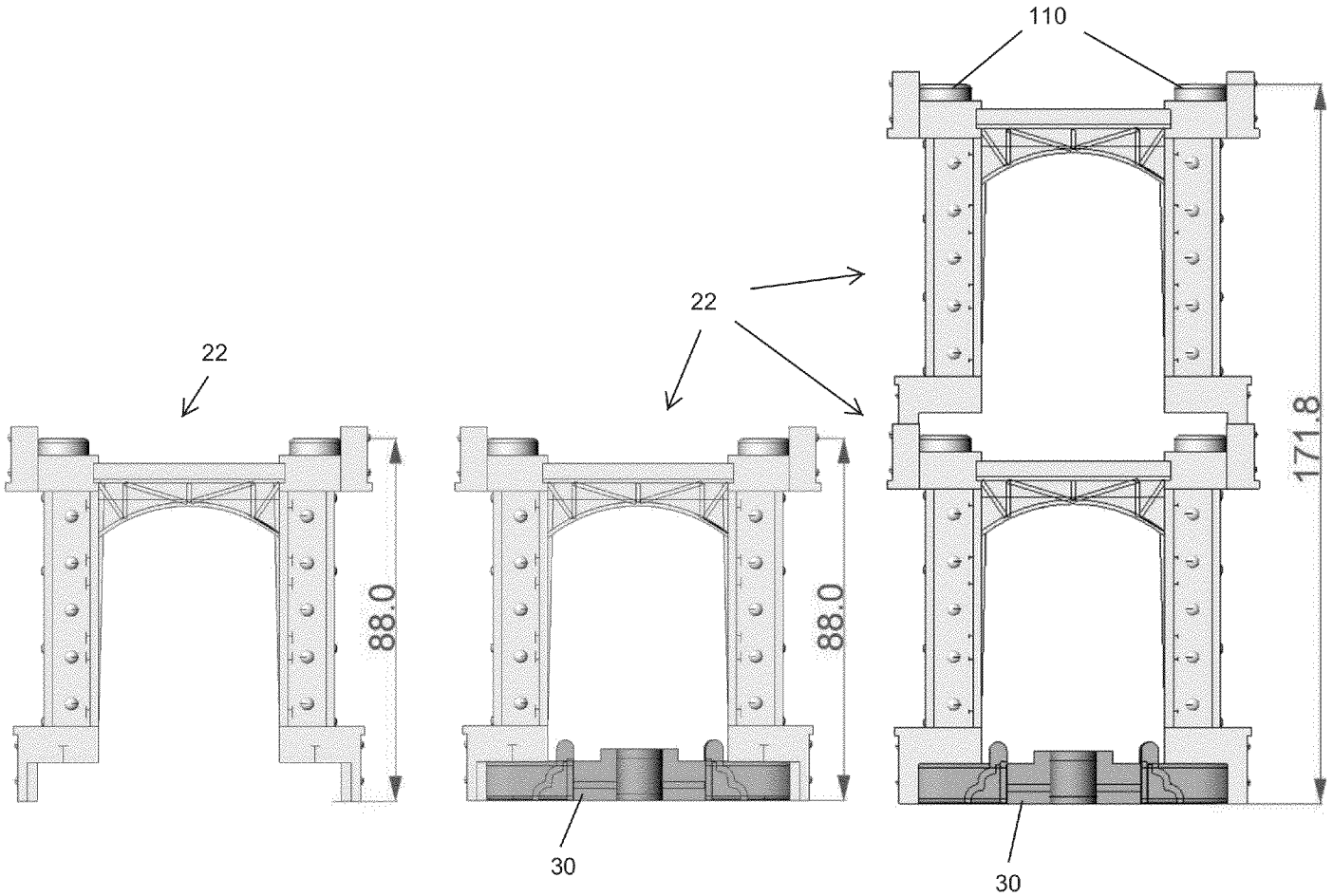
Figure 10:
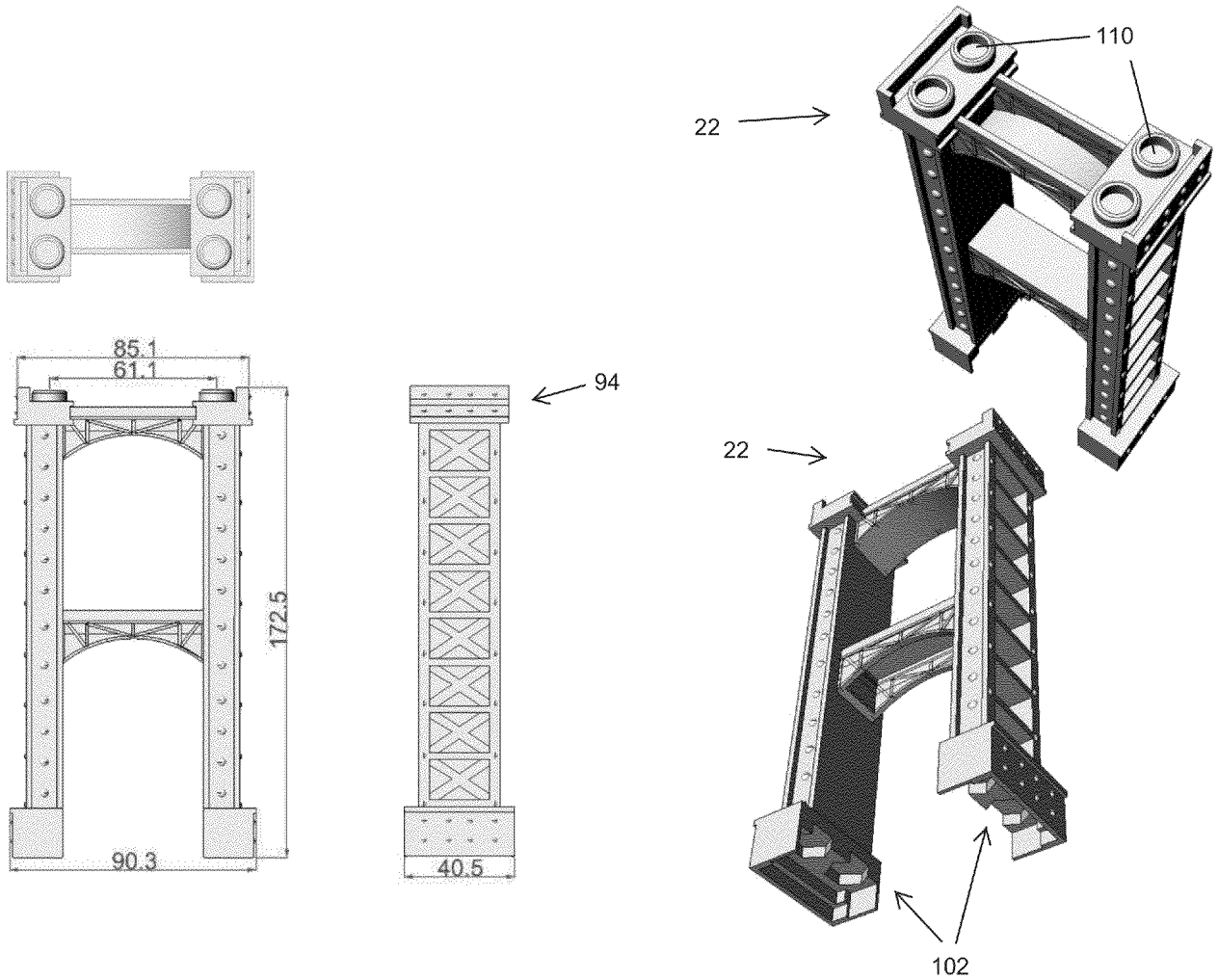

Some of the support pieces 22 illustrated in FIGS. 8-10 include a first post 86, a second post 90, and an elevated platform 94 connected to the first post 86 and the second post 90. The first post 86 and the second post 90 include a first end 98 having a female connector 102 configured to receive the male connection points 78. The first post 86 and the second post 90 include a second end 106 having a male connector 110 configured to receive the female connector 102 of another support piece 22. This configuration allows multiple support pieces 22 to be connected together and stacked to create a multi-level track layout.

The platform 26 illustrated in FIGS. 33-34 and 38 include a bottom surface 114 and a top surface 118. The bottom surface 114 includes a plurality of female connectors 122 configured to couple to the male connection points 78. The platform 26 is fully supported by the track piece 10 to which it is connected and cantilevers from the side of the track piece 10. The platform 26 can support a destination/playset.

Figure 40:
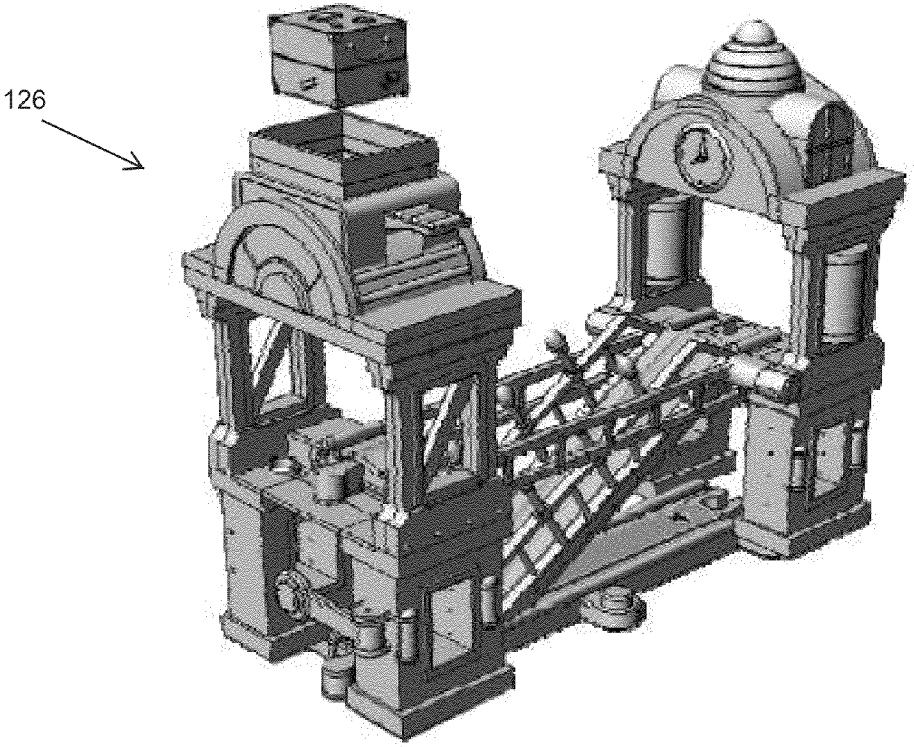
FIGS. 40-43 illustrate several destinations/playsets useable with the toy track system.

For example, a collapsing bridge 126 is a destination or playset that can be connected to the track pieces 10 with or without the platform 26. The collapsing bridge 126 is illustrated in FIG. 40 and is the first stop for the Cargo Car. The Cargo car passes through the open roof tunnel and can load cargo by the roof opening. After crossing the bridge 126, the car passes under the closed roof tunnel. There is a springtrigger mechanism that the Cargo Car activates. This causes the bridge 126 to collapse and the cargo car rolls down to the next stop. Note: the destination also has an Arming Slider Button. If this button is in the Non-Armed position, Engines and Cargo Car can pass thru for normal train play. The Flip Gate is for manual play—not mechanically linked. The Action Chugger (AC) has a special Activator Magnet to repair destinations. For the Collapsing Bridge 126, AC magnetically links to a metal insert in the bridge 126 arch and lifts it back into place.

Figure 41:
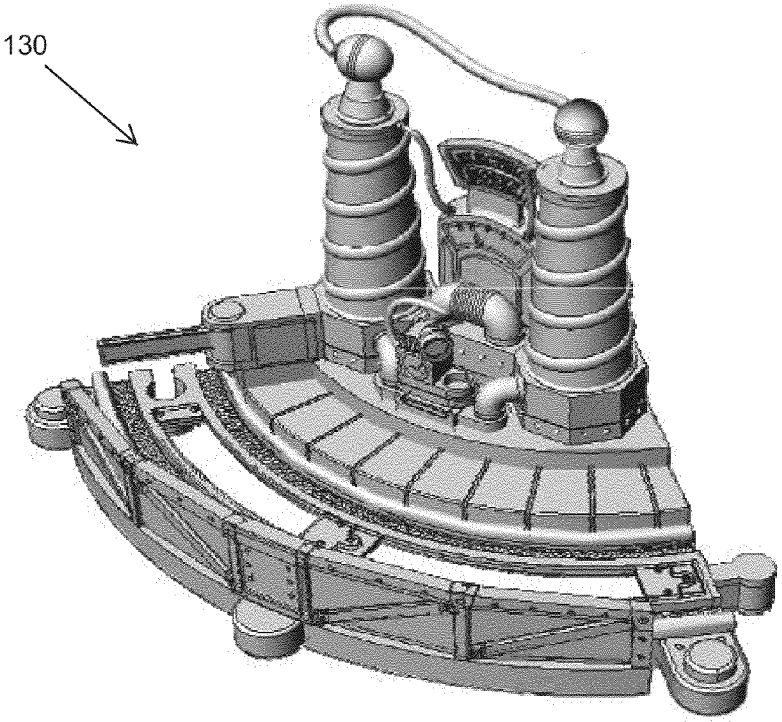

As another example, an electric station 130 is a destination or playset that can be connected to the track pieces 10 with or without the platform 26. The electric station 130 is illustrated in FIG. 41 and is the second stop for the Cargo Car. The Cargo car passes the lift gate. A rigid PP "cable" links the two towers. There is a springtrigger mechanism at the base of the lift gate that the Cargo Car activates. This causes the cable tower to unwind Counter-Clockwise (CCW) minimum 4 revolutions free-spinning. Note: the Electric Station 130 also has an Arming Slider Button. If this button is in the Non-Armed position, Engines and Cargo Car can pass by for normal train play. The Flip Gate is for manual play—not mechanically linked. The AC pushes on the cable to spring load the tower and reattach the cable. One (1) Revolution Clockwise resets the spring action. The cable aligns with the tower by a slight detent. This spring loads the cable for the next damage cycle. This mechanism is clutched out so the child cannot over-wind the cable by hand. The Electric Station 130 also has a nozzle with a string tether for manual play.

Figure 42:
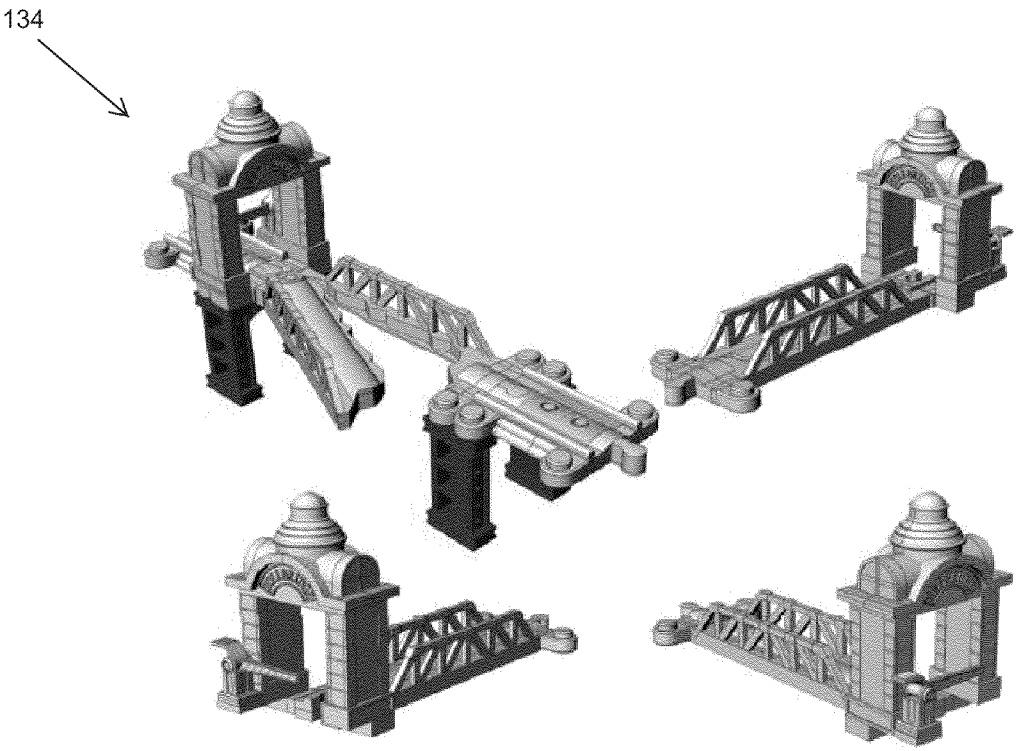

As another example, a toll booth 134 is a destination or playset that can be connected to the track pieces 10 with or without the platform 26. The toll booth 134 is illustrated in FIG. 42 and is the third stop for the Cargo Car. There is a springtrigger mechanism at the base of the lift gate that the Cargo Car activates. This causes the road to pivot open horizontally approx. 30° as if cracked. The cargo car then rolls off the track. Note: the Toll Booth 134 also has an Arming Slider Button. If this button is in the Non-Armed position, Engines and Cargo Car can pass by for normal train play. The Flip Gate is for manual play—not mechanically linked. The AC uses the Activator Magnet to pivot the road closed.

Figure 43:
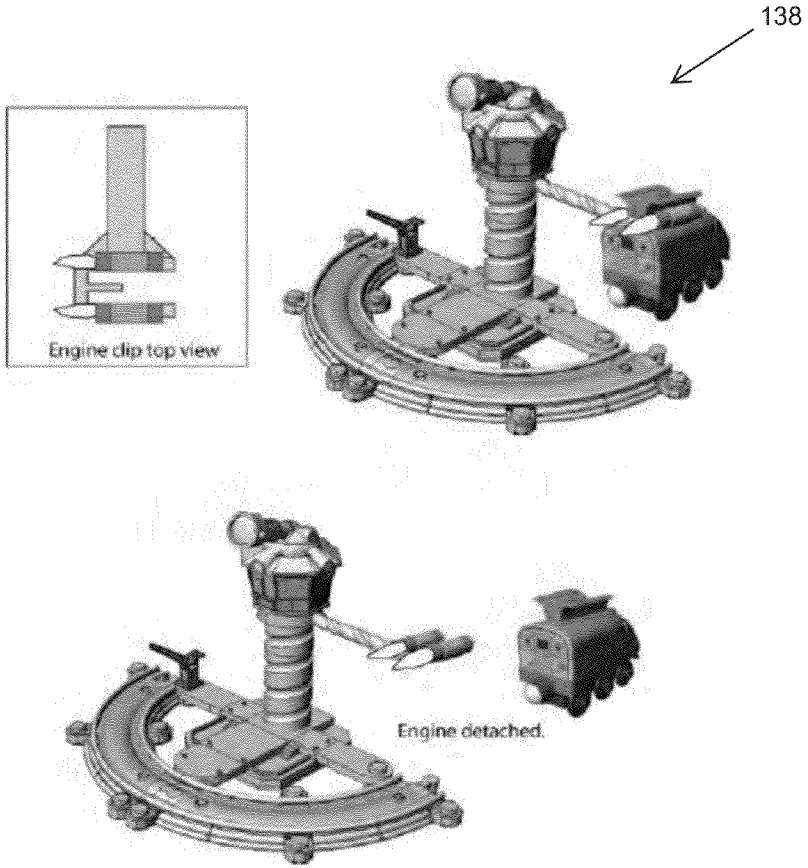

As another example, a control tower 138 is a destination or playset that can be connected to the track pieces 10 with or without the platform 26. The control tower 138 is illustrated in FIG. 43 and is the fourth stop for the Cargo Car. This is the payoff for running the Cargo Car thru first through third stops. Pressing the Release Trigger at the top causes the Pivot Arm to unwind Counter-Clockwise four revolutions, with AC "flying" down by gravity. This also triggers Lights & Sounds SFX. The AC has standard magnet pins on both ends. AC attaches to the end of the arm by linking to an attachment bracket (like a forklift) under his open wings. When plugged in from the back AC makes a perfect landing on the middle of the curved track and rolls away from the attachment bracket. The user lifts the arm straight up into the armed mode. A ratchet mechanism allows this reset.

The foregoing is provided for purposes of illustrating, explaining, and describing embodiments of the invention. Modifications and adaptations to these embodiments will be apparent to those skilled in the art and may be made without departing from the scope or spirit of this invention.

Various features and advantages of the invention are set forth in the following claims.

What is claimed is:

1. A toy track system comprising:

a first track piece including a male connector;

a second track piece including a female connector configured to receive the male connector of the first track piece;

a single piece track surface having two open channels to receive and guide a portion of a toy vehicle;

at least one of the first track piece and the second track piece further including a recess configured to receive the track surface, wherein the track surface comprises a material different than a material of the at least one of the first track piece and the second track piece.

2. The toy track system of claim 1 wherein the recess includes a post and the track surface includes an aperture, and wherein the post is configured to receive the aperture to secure the track surface in the recess.

3. The toy track system of claim 1 wherein one of the first track piece and the second track piece further includes a base and a sidewall that at least partially define the recess, and wherein the one of the first track piece and the second track piece further includes at least one male connector extending from one of the base and the sidewall.

4. The toy track system of claim 3 further comprising a platform including a female connector configured to receive the at least one male connector extending from one of the base and the sidewall.

5. The toy track system of claim 4 wherein the platform is a cantilever.

6. The toy track system of claim 3 further comprising a vertically-oriented support including a first end and a second end, the first end including a female connector configured to receive the at least one male connector extending from one of the base and the sidewall.

7. The toy track system of claim 6 wherein the second end of the vertically-oriented support includes a male connector configured to receive the female connector of a second vertically-oriented support.

8. The toy track system of claim 7 wherein the vertically-oriented supports provide varying elevations for the track pieces.

9. The toy track system of claim 6 wherein at least a portion of the vertically-oriented support extends across the track piece.

10. The toy track system of claim 1, wherein the toy vehicle is a toy train.

11. A toy track system comprising:

a plurality of track pieces configured to connect together to form a track layout;

a plurality of platforms configured to connect to the track pieces and further configured to support a destination positioned adjacent to the track pieces, wherein the plurality of platforms are fully supported by the track pieces to which the plurality of platforms are connected, and cantilever from sides of the track pieces;

a plurality of vertically-oriented supports configured to connect to the track pieces and provide a plurality of elevations to the track layout; and wherein the track pieces and the platforms are geometrically dimensioned to provide a modular assembly process of the track layout.

12. The toy track system of claim 11, wherein the track pieces include a first track piece including a male connector and a second track piece including a female connector configured to receive the male connector of the first track piece.

13. The toy track system of claim 12, wherein the toy track system further comprises a track surface having at least one open channel to receive and guide a portion of the toy, wherein at least one of the first track piece and the second track piece further includes a recess configured to receive the track surface, and wherein the track surface comprises a material different than a material of the at least one of the first track piece and the second track piece.

14. The toy track system of claim 13 wherein the recess includes a post and the track surface includes an aperture, and wherein the post is configured to receive the aperture to secure the track surface in the recess.

15. The toy track system of claim 13 wherein one of the first track piece and the second track piece further includes a base and a sidewall that at least partially define the recess, and wherein the one of the first track piece and the second track piece further includes at least one male connector extending from one of the base and the sidewall.

16. The toy track system of claim 15 wherein one of the plurality of platforms includes a female connector configured to receive the at least one male connector extending from one of the base and the sidewall.

17. The toy track system of claim 15 wherein one of the plurality of vertically-oriented supports includes a first end and a second end, the first end including a female connector configured to receive the at least one male connector extending from one of the base and the sidewall.

18. The toy track system of claim 17 wherein the second end of the vertically-oriented support includes a male connector configured to receive the female connector of a second vertically-oriented support.

19. The toy track system of claim 11 wherein at least a portion of one of the plurality of vertically-oriented support extends across one of the plurality of track pieces.

20. The toy track system of claim 11 wherein the plurality of vertically-oriented supports provide varying elevations for the plurality of track pieces.

* * * * *